US012600587B2

(12) United States Patent
Niwata et al.

(10) Patent No.: US 12,600,587 B2
(45) Date of Patent: Apr. 14, 2026

(54) MEDIUM FEED APPARATUS TO ADVANCE SUCCEEDING SHEET OF MEDIUM WHEN PRECEDING SHEET OF MEDIUM PASSES PICK ROLLER

(71) Applicant: PFU LIMITED, Kahoku (JP)

(72) Inventors: Tomoyuki Niwata, Kahoku (JP); Shota Otsuka, Kahoku (JP)

(73) Assignee: PFU LIMITED, Kahoku (JP)

( * ) Notice: Subject to any disclaimer, the term of this patent is extended or adjusted under 35 U.S.C. 154(b) by 74 days.

(21) Appl. No.: 18/352,816

(22) Filed: Jul. 14, 2023

(65) Prior Publication Data

US 2024/0067475 A1 Feb. 29, 2024

(30) Foreign Application Priority Data

Aug. 24, 2022 (JP) ..... 2022-133605

(51) Int. Cl.
*B65H 3/52* (2006.01)
*B65H 3/06* (2006.01)
(Continued)

(52) U.S. Cl.
CPC ..... *B65H 7/12* (2013.01); *B65H 3/06* (2013.01); *B65H 3/0669* (2013.01);
(Continued)

(58) Field of Classification Search
CPC ... B65H 7/02; B65H 7/06; B65H 7/12; B65H 7/14; B65H 7/18; B65H 7/20;
(Continued)

(56) References Cited

U.S. PATENT DOCUMENTS 7,357,387 B2 * 4/2008 Asada ..... B65H 7/18 271/265.01
2010/0225045 A1 * 9/2010 Kimura ..... B65H 3/0684 271/10.09
(Continued)

FOREIGN PATENT DOCUMENTS

JP 09301573 A * 11/1997
JP 10-126774 A 5/1998
(Continued)

*Primary Examiner* — Luis A Gonzalez
(74) *Attorney, Agent, or Firm* — Womble Bond Dickinson (US) LLP

(57) ABSTRACT

A medium feed apparatus includes a stacking tray, a pick roller located at an upstream side from a feed roller and separation roller in the medium conveyance direction, a first sensor located at an upstream side from the pick roller in the medium conveyance direction, a second sensor located at a downstream side from the feed roller and the separation roller in the medium conveyance direction, and a processor to rotate the pick roller and the feed roller in a medium feed direction to feed a plurality of sheets of the medium stacked on the stacking. The processor stops the pick roller when the second sensor detects a front end of a preceding sheet of the medium and rotates the pick roller again to advance a succeeding sheet of the medium when the first sensor detects a back end of the preceding sheet of the medium.

14 Claims, 12 Drawing Sheets

(51) Int. Cl.

| | |
|---|---|
| ***B65H 7/02*** | (2006.01) |
| ***B65H 7/06*** | (2006.01) |
| ***B65H 7/12*** | (2006.01) |
| ***B65H 7/18*** | (2006.01) |
| ***B65H 7/20*** | (2006.01) |

(52) U.S. Cl.
CPC ..... *B65H 3/0684* (2013.01); *B65H 3/5261* (2013.01); *B65H 7/06* (2013.01); *B65H 7/18* (2013.01); *B65H 7/20* (2013.01); *B65H 2511/514* (2013.01); *B65H 2513/512* (2013.01); *B65H 2553/51* (2013.01); *B65H 2801/12* (2013.01)

(58) Field of Classification Search
CPC .. B65H 3/0684; B65H 3/0669; B65H 3/0676; B65H 3/5261; B65H 2513/51; B65H 2513/512; B65H 2553/51
See application file for complete search history.

(56) References Cited

U.S. PATENT DOCUMENTS

| | | | | |
|---|---|---|---|---|
| 2012/0119436 | A1* | 5/2012 | Morita ..... | B65H 7/14 271/259 |
| 2017/0166411 | A1 | 6/2017 | Kawarago et al. | |

FOREIGN PATENT DOCUMENTS

| | | | |
|---|---|---|---|
| JP | 2012-140206 | A | 7/2012 |
| JP | 2017-105602 | A | 6/2017 |

* cited by examiner

MEDIUM FEED APPARATUS TO ADVANCE SUCCEEDING SHEET OF MEDIUM WHEN PRECEDING SHEET OF MEDIUM PASSES PICK ROLLER

CROSS-REFERENCE TO RELATED APPLICATIONS

This application is based upon and claims the benefit of priority of prior Japanese Patent Application No. 2022-133605, filed on Aug. 24, 2022, the entire contents of which are incorporated herein by reference.

TECHNICAL FIELD

Embodiments discussed in the present specification relate to feed a medium.

BACKGROUND

A scanner or other medium feed apparatus feeds and captures images of a plurality of sheets of a medium while separating them into individual sheets. In such a medium feed apparatus, it is desired to reduce the time required for feed of the medium. However, if simply raising the feed speed of the medium or shortening the feed interval of the medium, there is a possibility that multi-feed of the medium will occur, it will become necessary to re-read the medium, and as a result the time required for feed of the medium will increase.

There is a feed apparatus using a pick roller, feed roller, and retard roller to perform a feed operation and separation operation. In this feed apparatus, the pick roller rotates in the conveyance direction to feed a sheet of paper S1 abutting against it and convey it to a separation nip part comprised of the feed roller and retard roller. If the back end of the sheet of paper S1 passes the nip part of the pick roller, the pick roller will operate to next feed a sheet of paper S2 below the sheet of paper S1 such that the front end of the sheet of paper S2 reach the separation nip part.

SUMMARY

According to some embodiments, a medium feed apparatus includes a stacking tray, a feed roller to feed a medium, a separation roller located facing the feed roller, a pick roller located at an upstream side from the feed roller and the separation roller in the medium conveyance direction, a first sensor located at an upstream side from the pick roller in the medium conveyance direction, a second sensor located at a downstream side from the feed roller and the separation roller in the medium conveyance direction, and a processor to rotate the pick roller and the feed roller in a medium feed direction to feed a plurality of sheets of the medium stacked on the stacking. The processor stops the pick roller when the second sensor detects a front end of a preceding sheet of the medium and rotates the pick roller again to advance a succeeding sheet of the medium when the first sensor detects a back end of the preceding sheet of the medium.

According to some embodiments, a medium feed method includes rotating a feed roller and a pick roller located at an upstream side from the feed roller and a separation roller located facing the feed roller in a medium conveyance direction in a medium feed direction to feed a plurality of sheets of the medium stacked on a stacking tray, stopping the pick roller when a second sensor located at a downstream side from the feed roller and the separation roller in the medium conveyance direction detects a front end of a preceding sheet of the medium, and rotating the pick roller again to advance a succeeding sheet of the medium when a first sensor located at an upstream side from the pick roller in the medium conveyance direction detects a back end of the preceding sheet of the medium.

According to some embodiments, a computer-readable, non-transitory medium stores executable instructions for feeding a medium. The executable instructions include rotating a feed roller and a pick roller located at an upstream side from the feed roller and a separation roller located facing the feed roller in a medium conveyance direction in a medium feed direction to feed a plurality of sheets of the medium stacked on a stacking tray, stopping the pick roller when a second sensor located at a downstream side from the feed roller and the separation roller in the medium conveyance direction detects a front end of a preceding sheet of the medium, and rotating the pick roller rotate again to advance a succeeding sheet of the medium when a first sensor located at an upstream side from the pick roller in the medium conveyance direction detects a back end of the preceding sheet of the medium.

DESCRIPTION OF EMBODIMENTS

It is to be understood that both the foregoing general description and the following detailed description are exemplary and explanatory, and are not restrictive of the invention, as claimed.

Hereinafter, a medium feed apparatus, medium feed method and computer-readable, non-transitory medium according to an embodiment, will be described with reference to the drawings. However, it should be noted that the technical scope of the invention is not limited to these embodiments, and extends to the inventions described in the claims and their equivalents.

Figure 1:
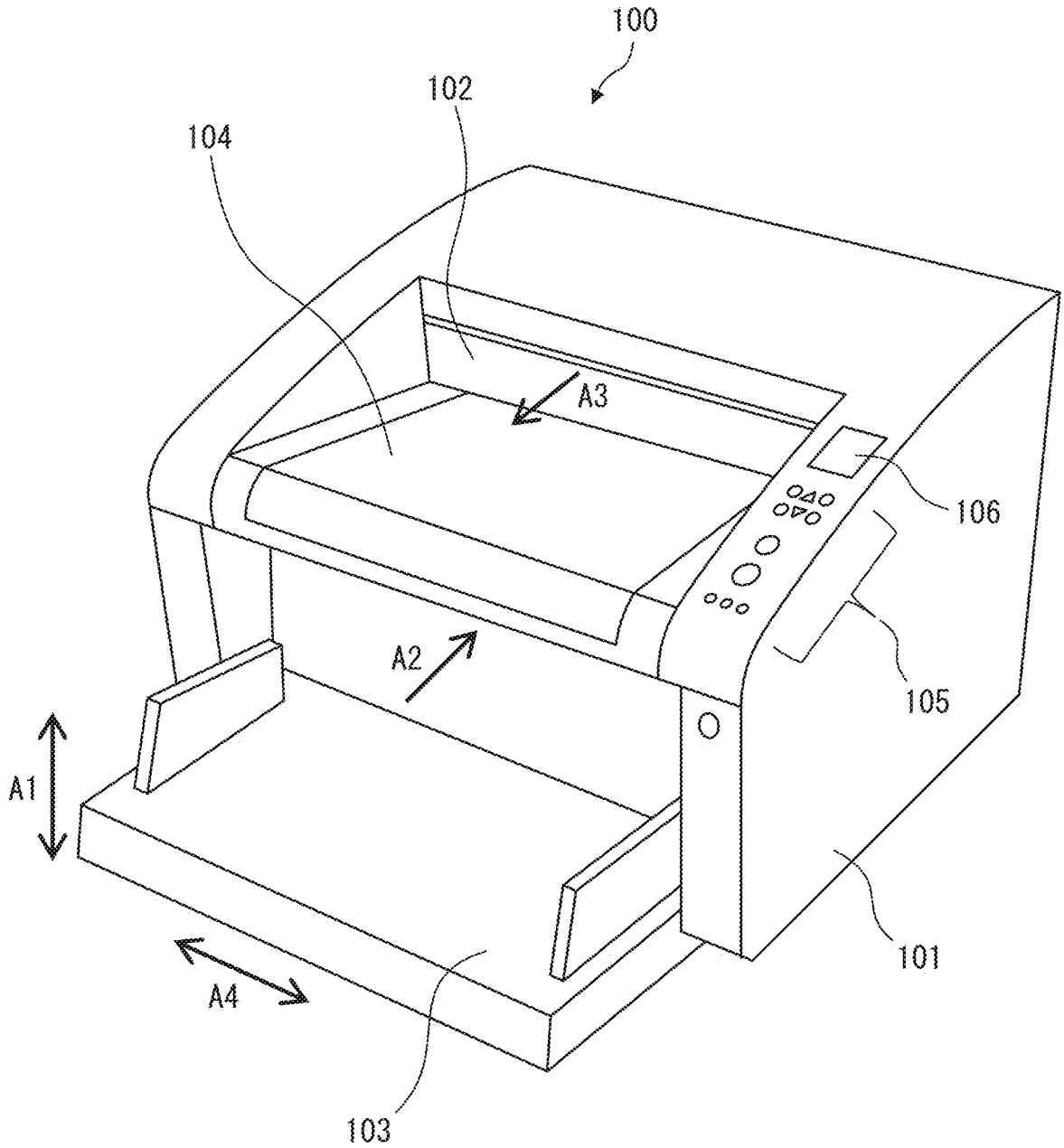
FIG. 1 is a perspective view illustrating an example of a medium feed apparatus.

FIG. 1 is a perspective view illustrating an example of a medium feed apparatus 100 constituted as an image scanner. The medium feed apparatus 100 conveys a document as a medium and captures an image of the medium. The medium is printing paper, thick paper, a card, etc. The medium feed apparatus 100 may be a facsimile, copier, multifunction peripheral (MFP), etc.

In FIG. 1, the arrow A1 indicates a substantially vertical direction (height direction), the arrow A2 indicates a medium conveyance direction, the A3 indicates a medium ejection direction, and the arrow A4 indicates a width direction perpendicular to the medium conveyance direction A2 or the medium ejection direction A3. Hereinafter, "upstream" means upstream in the medium conveyance direction A2 or medium ejection direction A3, while "downstream" means downstream in the medium conveyance direction A2 or medium ejection direction A3.

The medium feed apparatus 100 is provided with a first housing 101, second housing 102, stacking tray 103, ejection tray 104, operating device 105, display device 106, etc.

The second housing 102 is located at the inside of the first housing 101 and engages with the first housing to be able to turn by a hinge so as to be opened and closed at the time of jamming of the medium or the time of cleaning the inside of the medium feed apparatus 100, etc.

The stacking tray 103 engages with the first housing 101 to be able to stack the medium to be conveyed. The stacking tray 103 is provided at the side surface of the first housing 101 at the medium supply side movably in the height direction A1. When not conveying the medium, the stacking tray 103 is located at the bottom so that the medium is easily stacked. When conveying the medium, the stacking tray 103 rises to a position where the medium stacked at the top contacts a later explained pick roller.

The ejection tray 104 is formed on the second housing 102. The ejection tray 104 has a stacking surface 104*a* for stacking the medium and stacks the medium ejected from an ejection opening of the first housing 101 and the second housing 102.

The operating device 105 has buttons or other input devices and an interface circuit acquiring signals from the input devices, receives input operations of a user, and outputs operating signals corresponding to the input operations of a user. The display device 106 has a display including liquid crystals, organic Electro-Luminescence (El), etc., and an interface circuit outputting image data to the display and displaying the image data on the display. Note that the display device 106 may be a liquid crystal display with a touch panel function. In that case, the operating device 105 has an interface circuit for acquiring input signals from the touch panel.

Figure 2:
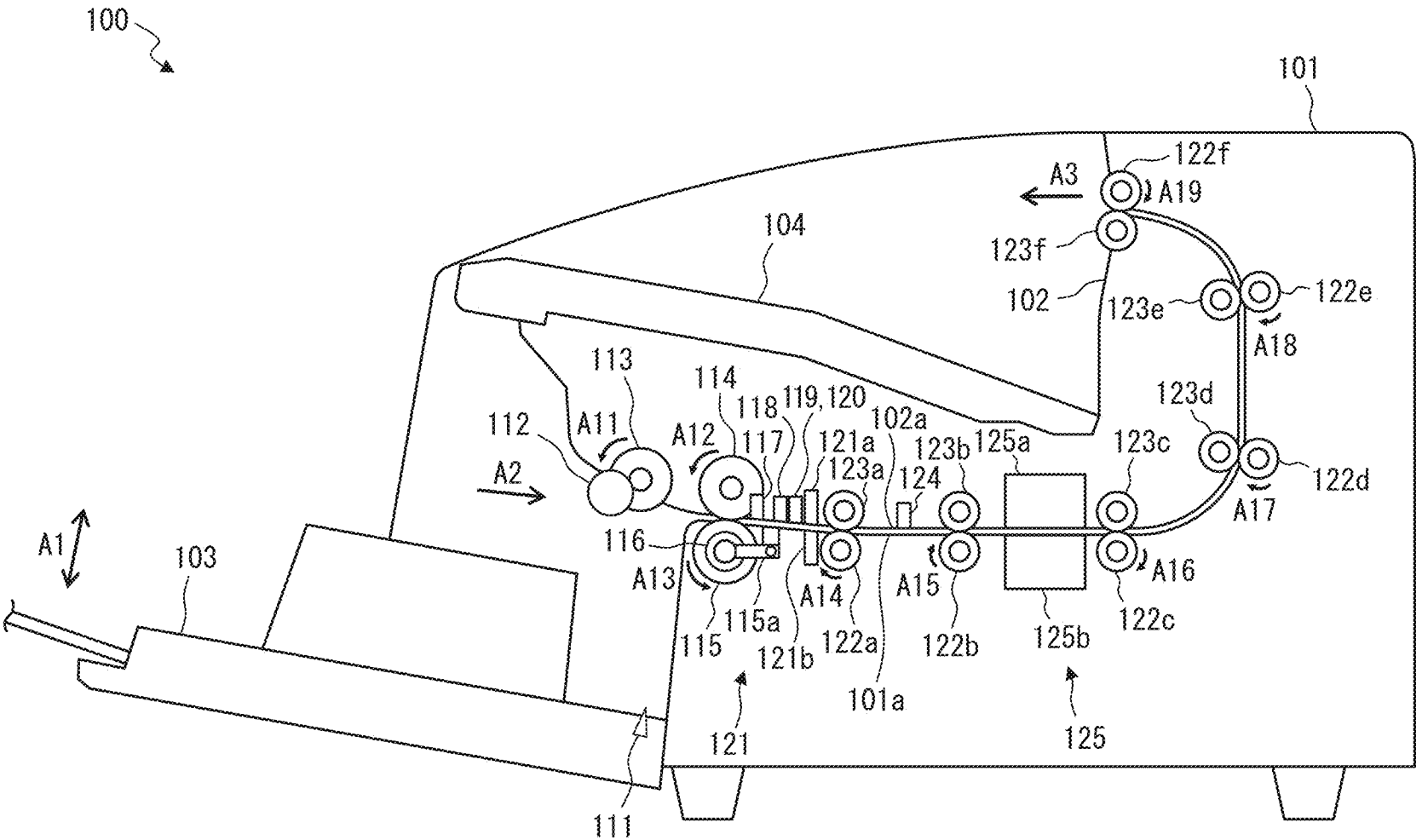
FIG. 2 is a view for explaining an example of a conveyance path inside of an example of a medium feed apparatus.

FIG. 2 is a view for explaining an example of a conveyance path inside of an example of a medium feed apparatus.

The conveyance path inside of the medium feed apparatus 100 has a first medium sensor 111, first encoder 112, pick roller 113, feed roller 114, separation roller 115, second encoder 116, second medium sensor 117, third medium sensor 118, first skew sensor 119, second skew sensor 120, ultrasonic sensor 121, first to sixth conveyance rollers 122*a* to 122*f*, first to sixth driven rollers 123*a* to 123*f*, a fourth medium sensor 124, imaging device 125, etc.

Note that, the numbers of the pick roller 113, feed roller 114, separation roller 115, first to sixth conveyance rollers 122*a* to 122*f*, and/or first to sixth driven rollers 123*a* to 123*f* are not limited to one and may be plural. In this case, the plurality of feed rollers 114, separation rollers 115, first to sixth conveyance rollers 122*a* to 122*f*, and/or first to sixth driven rollers 123*a* to 123*f* are located spaced apart in the width direction A4.

The second housing 102 is located facing the first housing 101 across the medium conveyance path. The surface of the first housing 101 facing the second housing 102 forms a first guide 101*a* of the medium conveyance path, while the surface of the second housing 102 facing the first housing 101 forms a second guide 102*a* of the medium conveyance path.

The first medium sensor 111 is located at the stacking tray 103, i.e., at an upstream side from the feed roller 114 and separation roller 115, and detects the stacking state of the medium at the stacking tray 103. The first medium sensor 111 determines whether the stacking tray 103 has the medium by a contact detection sensor which generates a predetermined current when the medium contacts it or when the medium does not contact it. The first medium sensor 111 generates and outputs a first medium signal with a signal value changing between a state where the stacking tray 103 has the medium and a state where the stacking tray 103 has no medium. Note that the first medium sensor 111 is not limited to a contact detection sensor. A photo detection sensor or any other sensor able to detect the presence of the medium may be used as the first medium sensor 111.

The first encoder 112 is an example of a first sensor. The first encoder 112 is located at the second housing 102 at an upstream side from the feed roller 114 and separation roller 115 in the medium conveyance direction A2 and detects a back end of the medium being fed by contacting and detecting the movement of the medium being fed. In particular, the first encoder 112 is located at an upstream side from the pick roller 113 in the medium conveyance direction A2, in particular in the vicinity of the pick roller 113. The first encoder 112 has a disk formed with a large number of slits (openings for passing light) and is provided so as to rotate in accordance with the movement of the medium being fed and a light emitter and light receiver provided so as to face each other with the disk in between. The light emitter is a Light Emitting Diode (LED), etc., and emits light toward the disk (light receiver). The light receiver is a photodiode, etc., and receives light emitted from the light emitter through the disk. The light receiver detects the number of changes within a predetermined time period from a state where there is a slit between the light emitter and light receiver to a state where there is no slit and the disk blocks the light. The light receiver multiplies the detected number of changes with a distance of movement of the outer circumferential surface of the first encoder 112 when the disk rotates by the distance between two mutually adjoining slits to detect the distance of movement of the medium being fed. The first encoder 112 generates and outputs a distance signal indicating the distance of movement detected. When the back end of the medium being fed passes the position of the first encoder 112, the distance of movement of the medium changes from a value larger than 0 to 0, so the first encoder 112 can detect the back end of the medium from the distance of movement of the medium. Note that, the first encoder 112 is not limited to an optical type encoder and may be a mechanical type encoder, magnetic type encoder, electromagnetic induction type encoder, or any other encoder.

The pick roller 113 is located at the second housing 102 at the upstream side from the feed roller 114 and separation roller 115 in the medium conveyance direction A2. The pick roller 113 contacts the sheet of the medium stacked at the top of the medium stacked on the stacking tray 103 when the stacking tray 113 has risen to substantially the same height as the medium conveyance path and conveys that sheet of the medium toward the downstream side. A one-way clutch is provided between the pick roller 113 and the motor imparting a drive force to the pick roller 113, therefore, the rotation of the pick roller 113 in the opposite direction to the medium feed direction A11 is limited.

The feed roller 114 is provided inside the second housing 102 at the downstream side from the pick roller 113 and feeds the medium stacked on the stacking tray 103 and fed by the pick roller 112 toward the further downstream side. If a plurality of feed rollers 114 are provided, the individual feed rollers 114 are provided to rotate independently by separate motors. The feed rollers 114 may be provided to rotate integrally by a common motor. A one-way clutch is provided between each feed roller 114 and the motor imparting drive force to the feed roller 114, therefore, the rotation of the feed roller 114 in a direction opposite to the medium feed direction A12 is restricted.

The separation roller 115 is located inside the first housing 101 facing the feed roller 114. The separation roller 115 is a so-called brake roller or retard roller and is provided to be able to rotate in an direction A13 opposite to the medium feed direction or to be able to stop. The feed roller 114 and separation roller 115 function as a separation part for performing separation of the medium and separate and feed the medium one sheet at a time. The feed roller 114 is located above the separation roller 115, and the medium feed apparatus 100 feeds the medium by the so-called top pick method. Note that the feed roller 114 may be located below the separation roller 115, and the medium feed apparatus 100 may feed the medium by the so-called bottom pick method.

A torque limiter is provided between the separation roller 115 and the motor imparting drive force to the separation roller 115 for prescribing a limit value of the torque acting on the separation roller 115. The limit value of the torque limiter is set to a value such that if there is a single sheet of the medium, the rotational force through the torque limiter is cut off, while if there are a plurality of sheets of the medium, rotational force through the torque limiter is transmitted. Therefore, if just one sheet of the medium is being conveyed, the separation roller 115 does not rotate with the drive force from the motor, but is driven by the feed roller 114. If a plurality of sheets of the medium are being conveyed, the separation roller 115 rotates in the direction A13 opposite to the medium feed direction to separate the sheet of the medium contacting the feed roller 114 from other sheets of the medium and prevent the occurrence of multi-feed. At this time, the outer circumferential surface of the separation roller 115 may apply force in the direction A13 opposite to the medium feed direction to the medium in a stopped state without rotating in the direction A13 opposite to the medium feed direction.

The separation roller 115 is supported by an arm 115*a* at the first housing 101. The separation roller 115 is attached to one end of the arm 115*a*. The other end of the arm 115*a* is attached to the first housing 101. The arm 115*a* is provided at the first housing 101 rotatably (swingably). The arm 115*a* is given a biasing force upward, i.e., in a direction where the separation roller 115 moves toward the feed roller 114 side, by a spring member or rubber member or other biasing member. Further, the arm 115*a* is given a rotational force by the drive force from a motor. The medium feed apparatus 100 rotates (swings) the arm 115*a* so as to adjust the pressing force of the separation roller 115 pressing the feed roller 114.

The second encoder 116 is one example of a third sensor. The second encoder 116 is attached to a shaft of the rotational axis of the separation roller 115 in the second housing 102 and detects rotation of the separation roller 115. The second encoder 116 has a disk formed with a large number of slits (openings for passing light) and is provided to rotate along with rotation of the separation roller 115 and a light emitter and light receiver provided to face each other with the disk in between. The light emitter is an LED, etc., and emits light toward the disk (light receiver). The light receiver is a photodiode, etc., and receives light emitted by the light emitter through the disk. The light receiver detects the number of changes within a predetermined time period from a state where there is a slit between the light emitter and the light receiver to a state where there is no slit and light is blocked by the disk. The light receiver multiplies the detected number of changes with the distance by which the outer circumferential surface of the separation roller 115 moves when the disk rotates by distance between two mutually adjoining slits to detect the distance of movement of the outer circumferential surface of the separation roller 115. Further, between the light emitter and light receiver, a fixed slit is provided between the light emitter and the light receiver so that the output signal (pulse) becomes biphasic. The light receiver detects the direction of rotation of the disk by the rising timings of the output signals of the phases. The second encoder 116 generates and outputs a rotation signal indicating the detected distance of movement and rotational direction of the disk (stop/forward direction/backward direction). Note that, the second encoder 116 is not limited to an optical type encoder and may be a mechanical type encoder, magnetic type encoder, electromagnetic induction type encoder, or any other encoder.

The second medium sensor 117 is one example of a second sensor. The second medium sensor 117 is located at a downstream side from the feed roller 114 and separation roller 115 and the upstream side from the first conveyance roller 122*a* and the first driven roller 123*a* in the medium conveyance direction A2, and detects a medium. In particular, the second medium sensor 117 is located in the vicinity of the feed roller 114 and separation roller 115. The second medium sensor 117 includes a light emitter and a light receiver provided at one side of the medium conveyance path and a light guide provided at a position facing the light emitter and the light receiver with the medium conveyance path in between. The light emitter is an LED, etc., and emits light toward the medium conveyance path. The light receiver is a photodiode, etc., and receives light emitted by the light emitter and guided by the light guide. Based on the intensity of the light received by the light receiver, the second medium sensor 117 generates and outputs a second medium signal with a signal value changing between the state where there is the medium and the state where there is no medium.

The third medium sensor 118 is located at a downstream side from the feed roller 114 and separation roller 115 and the upstream side from the first conveyance roller 122*a* and the first driven roller 123*a* in the medium conveyance direction A2, and detects a medium. In other words, the third medium sensor 118 is located between the feed roller 114 and separation roller 115 and the first conveyance roller 122*a* and the first driven roller 123*a* in the medium conveyance direction A2. In particular, the third medium sensor 118 is located at the downstream side from the second medium sensor 117 in the medium conveyance direction A2. The third medium sensor 118 includes a light emitter and a light receiver provided at one side of the medium conveyance path and a light guide provided at a position facing the light emitter and the light receiver across the medium conveyance path. The light emitter is an LED, etc., and emits light toward the medium conveyance path. On the other hand, the light receiver is a photodiode, etc., and receives light emitted by the light emitter and guided by the light guide. Based on the intensity of the light received by the light receiver, the third medium sensor 118 generates and outputs a third medium signal with a signal value changing between the state where there is the medium and the state where there is no medium.

The first skew sensor 119 and the second skew sensor 120 are located at a downstream side from the feed roller 114 and separation roller 115 and the upstream side from the first conveyance roller 122*a* and the first driven roller 123*a* in the medium conveyance direction A2, and detect a medium. In particular, the first skew sensor 119 and the second skew sensor 120 are located at a downstream side from the third medium sensor 118 in the medium conveyance direction A2. The first skew sensor 119 and the second skew sensor 120 may be located at an upstream side from the third medium sensor 118 in the medium conveyance direction A2. The first skew sensor 119 and the second skew sensor 120 are located at the same position in the medium conveyance direction A2 and aligned spaced apart in the width direction A4.

The first skew sensor 119 includes a light emitter and a light receiver provided at one side of the medium conveyance path and a light guide provided at a position facing the light emitter and the light receiver with the medium conveyance path in between. The light emitter is an LED, etc., and emits light toward the medium conveyance path. On the other hand, the light receiver is a photodiode, etc., and receives light emitted by the light emitter and guided by the light guide. Based on the intensity of the light received by the light receiver, the first skew sensor 119 generates and outputs a first skew signal with a signal value changing between the state where there is the medium and the state where there is no medium.

The second skew sensor 120 includes a light emitter and a light receiver provided at one side of the medium conveyance path and a light guide provided at a position facing the light emitter and the light receiver with the medium conveyance path in between. The light emitter is an LED, etc., and emits light toward the medium conveyance path. The light receiver is a photodiode, etc., and receives light emitted by the light emitter and guided by the light guide. Based on the intensity of the light received by the light receiver, the second skew sensor 120 generates and outputs a second skew signal with a signal value changing between the state where there is the medium and the state where there is no medium.

The ultrasonic sensor 121 is located at the downstream side from the feed roller 114 and separation roller 115 and the upstream side from the first conveyance roller 122*a* and the first driven roller 123*a*. The ultrasonic sensor 121 may be located at the downstream side from the first conveyance roller 122*a* and the first driven roller 123*a*. The ultrasonic sensor 121 includes an ultrasonic wave transmitter 121*a* and ultrasonic wave receiver 121*b* located in the vicinity of the medium conveyance path facing each other with the medium conveyance path in between. The ultrasonic wave transmitter 121*a* transmits an ultrasonic wave. The ultrasonic wave receiver 121*b* receives the ultrasonic wave transmitted by the ultrasonic wave transmitter 121*a* and passing through the medium and generates and outputs an electrical signal corresponding to the received ultrasonic wave as an ultrasonic wave signal. The ultrasonic wave signal indicates the magnitude of the ultrasonic wave passing through the medium being fed.

The first to sixth conveyance rollers 122*a* to 122*f* and the first to sixth driven rollers 123*a* to 123*f* are located facing each other at the downstream side from the feed roller 114 and separation roller 115 in the medium conveyance direction A2. The first to sixth conveyance rollers 122*a* to 122*f* and the first to sixth driven rollers 123*a* to 123*f* convey the medium fed by the feed roller 114 and separation roller 115 toward the downstream side. The sixth conveyance roller 122*f* and sixth driven roller 123*f* eject the medium to the ejection tray 104.

The fourth medium sensor 124 is located at the downstream side from the first conveyance roller 122*a* and the first driven roller 123*a* and the upstream side from the second conveyance roller 122*b* and second driven rollers 123*b* in the medium conveyance direction A2, and detects the medium. The fourth medium sensor 124 may be located at the downstream side from the second conveyance roller 122*b* and the second driven roller 123*b* in the medium conveyance direction A2 and the upstream side from the imaging device 125. The fourth medium sensor 124 includes a light emitter and a light receiver provided at one side of the medium conveyance path and a light guide provided at a position facing the light emitter and the light receiver with the medium conveyance path in between. The light emitter is an LED, etc., and emits light toward the medium conveyance path. The light receiver is a photodiode, etc., and receives light emitted by the light emitter and guided by the light guide. Based on the intensity of the light received by the light receiver, the fourth medium sensor 124 generates and outputs a fourth medium signal with a signal value changing between the state where there is the medium at the position of the fourth medium sensor 124 and the state where there is no medium.

Note that, instead of a light guide, a mirror or other reflection member may be used in the second medium sensor 117, third medium sensor 118, first skew sensor 119, second skew sensor 120, and/or fourth medium sensor 124. Further, the light emitter and light receiver in the sensors may be provided facing each other with the medium conveyance path in between. Further, the sensors may detect the presence of a medium by a contact detection sensor, etc., running a predetermined current if the medium is contacted or if the medium is not contacted.

The imaging device 125 is located at a downstream side from the first to the second conveyance rollers 122*a* and 122*b* in the medium conveyance direction A2 and captures the medium conveyed by the first and the second conveyance rollers 122*a* and 122*b* and the first and second driven rollers 123*a* and 123*b*. The imaging device 125 includes a first imaging device 125*a* and second imaging device 125*b* located facing each other with the medium conveyance path in between. The first imaging device 125*a* is provided at the second housing 102, while the second imaging device 125*b* is provided at the first housing 101.

The first imaging device 125*a* includes a line sensor constructed from a contact image sensor (CIS) of a unit magnification optical system type including imaging elements based on a complementary metal oxide semiconductor (CMOS) and aligned in the main scanning direction. The first imaging device 125*a* also includes lenses that form images on the imaging elements, and an A/D converter that amplifies analog electric signals outputted from the imaging elements and converts them to digital signals. The first imaging device 125*a* images the front side of a medium being conveyed, generates an input image, and outputs it.

Similarly, the second imaging device 125*b* includes a line sensor constructed from a CIS of a unit magnification optical system type including imaging elements based on a CMOS and aligned in the main scanning direction. The second imaging device 125*b* also includes lenses that form images on the imaging elements, and an A/D converter that amplifies analog electric signals outputted from the imaging elements and converts them to digital signals. The second imaging device 119*b* images the back side of a medium being conveyed, generates an input image, and outputs it.

Note that, the medium feed apparatus 100 may have only one of the first imaging device 125*a* and the second imaging device 125*b* and read only one surface of the medium. Further, instead of a contact optical system type CIS line sensor provided with imaging elements based on CMOS's, a contact optical system type CIS line sensor with imaging elements based on Charge Coupled Devices (CCDs) may be utilized. Further, a reduction optical system type line sensor provided with imaging elements based on CMOS's or CCD's may be utilized.

The medium stacked on the stacking tray 103 is conveyed between the first guide 101*a* and the second guide 102*a* toward the medium conveyance direction A2 by the pick roller 113 and the feed roller 114 respectively rotating in the medium feed directions A11, A12. The medium feed apparatus 100 has, a separation mode in which the medium is separated and fed and a nonseparation mode in which the medium is fed without being separated as feed modes. The feed mode is set by the user using the operating device 105 or an information processing apparatus coupled to the medium feed apparatus 100. If the feed mode is set to the separation mode, the separation roller 115 rotates in the direction of the arrow A13, i.e., the direction opposite to the medium feed direction, or stops. Therefore, feed of the medium other than the separated medium is restricted (multi-feed is prevented). If the feed mode is set to the nonseparation mode, the separation roller 115 rotates in the opposite direction to the arrow A13, i.e., in the medium feed direction.

The medium is sent to the imaging position of the imaging device 125 by being guided by the first guide 101*a* and the second guide 102*a* while the first to second conveyance rollers 122*a* to 122*b* rotate in the directions of the arrows A14 to A15 and is captured by the imaging device 125. Furthermore, the medium is ejected onto the ejection tray 104 by the third to the sixth conveyance rollers 122*c* to 122*f* respectively rotating in the directions of the arrows A16 to A19.

Figure 3A:
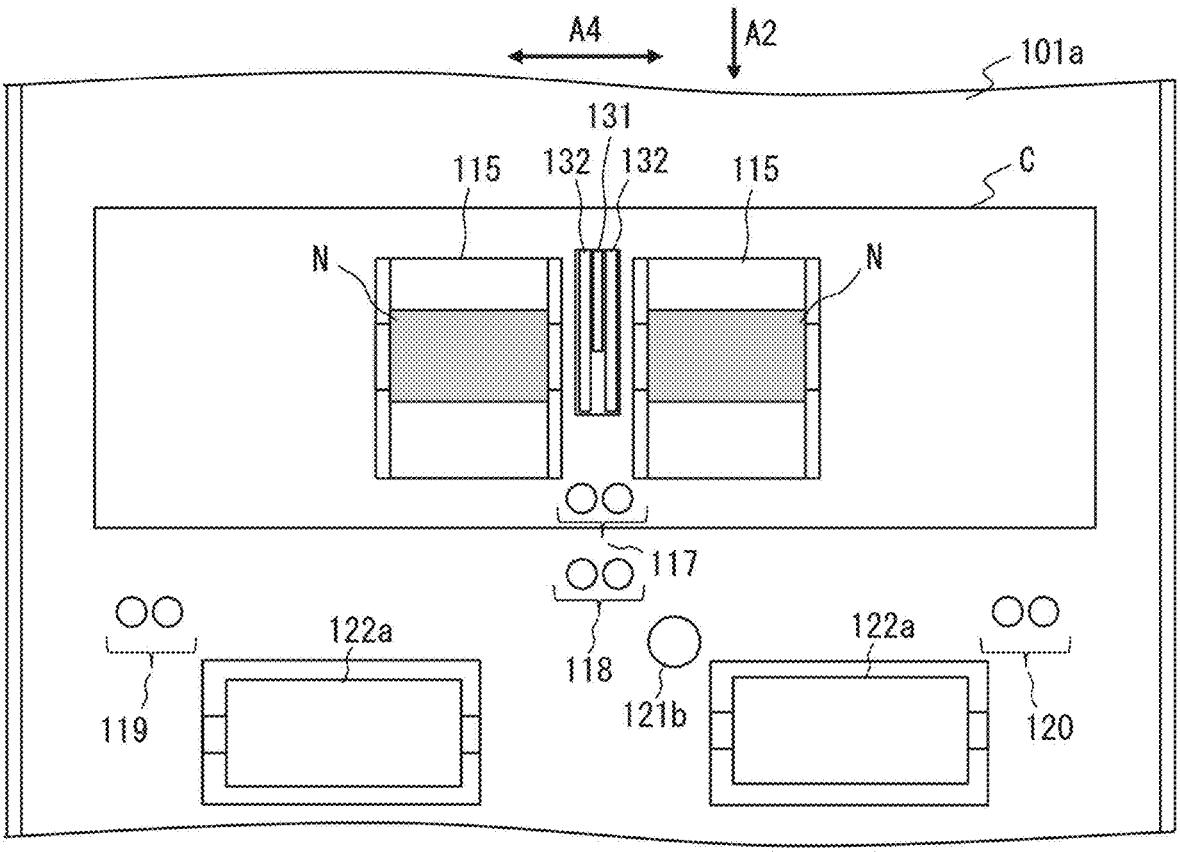
FIG. 3A is a schematic view for explaining an example of a first arm and an example of a second arm.
Figure 3B:
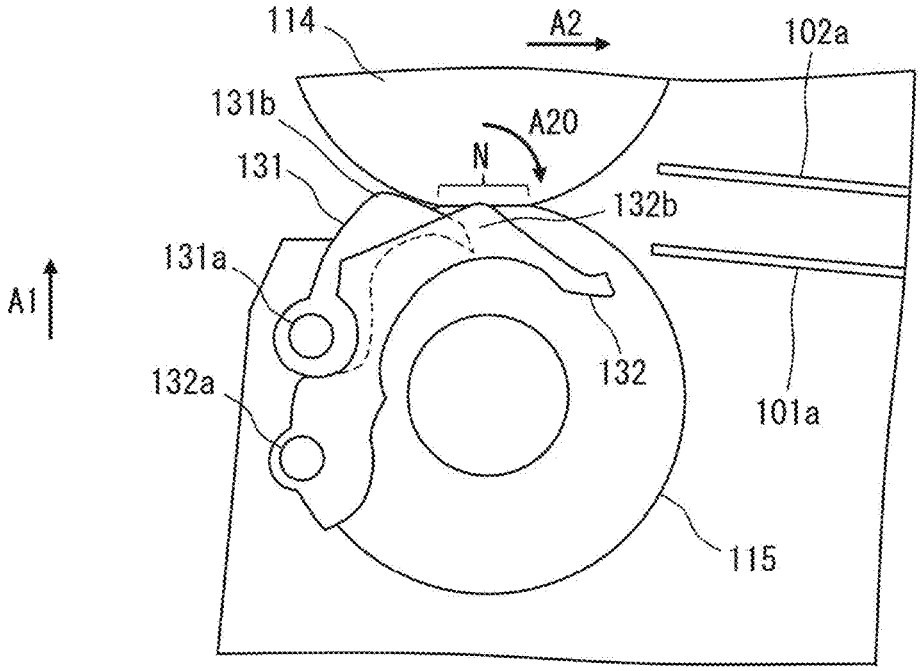
FIG. 3B is a schematic view for explaining an example of a first arm and an example of a second arm.

FIGS. 3A and 3B are schematic views for explaining an example of a first arm 131 and an example of a second arm 132. FIG. 3A illustrates a schematic view seen from above of the surroundings of the separation roller 115 in the first housing 101 with the second housing 102 opened, while FIG. 3B illustrates a schematic view seen from the side of the surroundings of the feed roller 114 and the separation roller 115.

As illustrated in FIGS. 3A and 3B, the medium feed apparatus 100 has the first arm 131 and second arm 132. In the example illustrated in FIGS. 3A and 3B, a plurality of separation rollers 115 are located spaced apart in the width direction A4 perpendicular to the medium conveyance direction. In this case, a plurality of feed rollers 114 are located spaced apart in the width direction A4 perpendicular to the medium conveyance direction as well so as to face the separation rollers 115.

The first arm 131 is a plate-shaped member extending along the medium conveyance direction A2 and is provided at the first housing 101 swingably (rotatably) in the height direction A1 about an upstream side end part 131*a*. The first arm 131 is located between the plurality of separation rollers 115 in the width direction A4 perpendicular to the medium conveyance direction. The first arm 131 has a first projecting part 131*b*. The first projecting part 131*b* is provided swingably so as to project out from the first guide 101*a*, i.e., the guide surface of the medium, and is located at an upstream side from nip parts N of the feed rollers 114 and the separation rollers 115 in the medium conveyance direction A2 with projecting out from the first guide 101*a*.

The second arm 132 is a plate-shaped member extending along the medium conveyance direction A2 and is provided at the first housing 101 swingably (rotatably) in the height direction A1 about an upstream side end part 132*a*. The second arm 132 is located between the plurality of separation rollers 115 in the width direction A4 perpendicular to the medium conveyance direction. A gap is provided at the center part of the second arm 132 in the width direction A4. The first arm 131 is located at the center part (gap) of the second arm 132 in the width direction A4. The second arm 132 has a second projecting part 132*b*. The second projecting part 132*b* is provided swingably so as to project out from the first guide 101*a*, i.e., the guide surface of the medium, and is located so as to overlap the nip parts N of the feed rollers 114 and the separation rollers 115 in the medium conveyance direction A2 with projecting out from the first guide 101*a*. In other words, the second projecting part 132*b* is located at the downstream side from the first projecting part 131*b* in the medium conveyance direction A2.

The medium fed to the separation part receives pressing force from the pick roller 113 and the feed roller 114. For this reason, there is a possibility of the medium buckling between the pick roller 113 and the feed roller 114 and the possibility of the separation roller 115 slipping and the medium jamming. As opposed to this, the first projecting part 131*b* and the second projecting part 132*b* push the center part in the width direction A4 of the medium being fed upward. Due to this, the medium being fed bends in a wavy manner in the width direction A4, so the medium feed apparatus 100 can stiffen the medium and can improve the rigidity of the medium moving along the medium conveyance direction A2.

For this reason, even if thin sheets of paper with weak stiffness are fed to the separation part, the medium feed apparatus 100 can keep the medium from buckling and jamming. Further, even when a medium comprising several sheets of paper such as an envelope or carbon paper is fed to the separation part, the medium feed apparatus 100 can keep the medium from jamming by imparting the medium with enough stiffness to withstand separation force from the separation roller 115. In particular, the medium feed apparatus 100 uses the first projecting part 131*b* and the second projecting part 132*b* located at mutually different positions in the medium conveyance direction A2 to stiffen the medium in two stages. Therefore, even when a plurality of media are fed in an overlapping state to the separation part, the medium feed apparatus 100 can keep the medium from buckling or jamming by giving the medium with higher stiffness.

Figure 4:
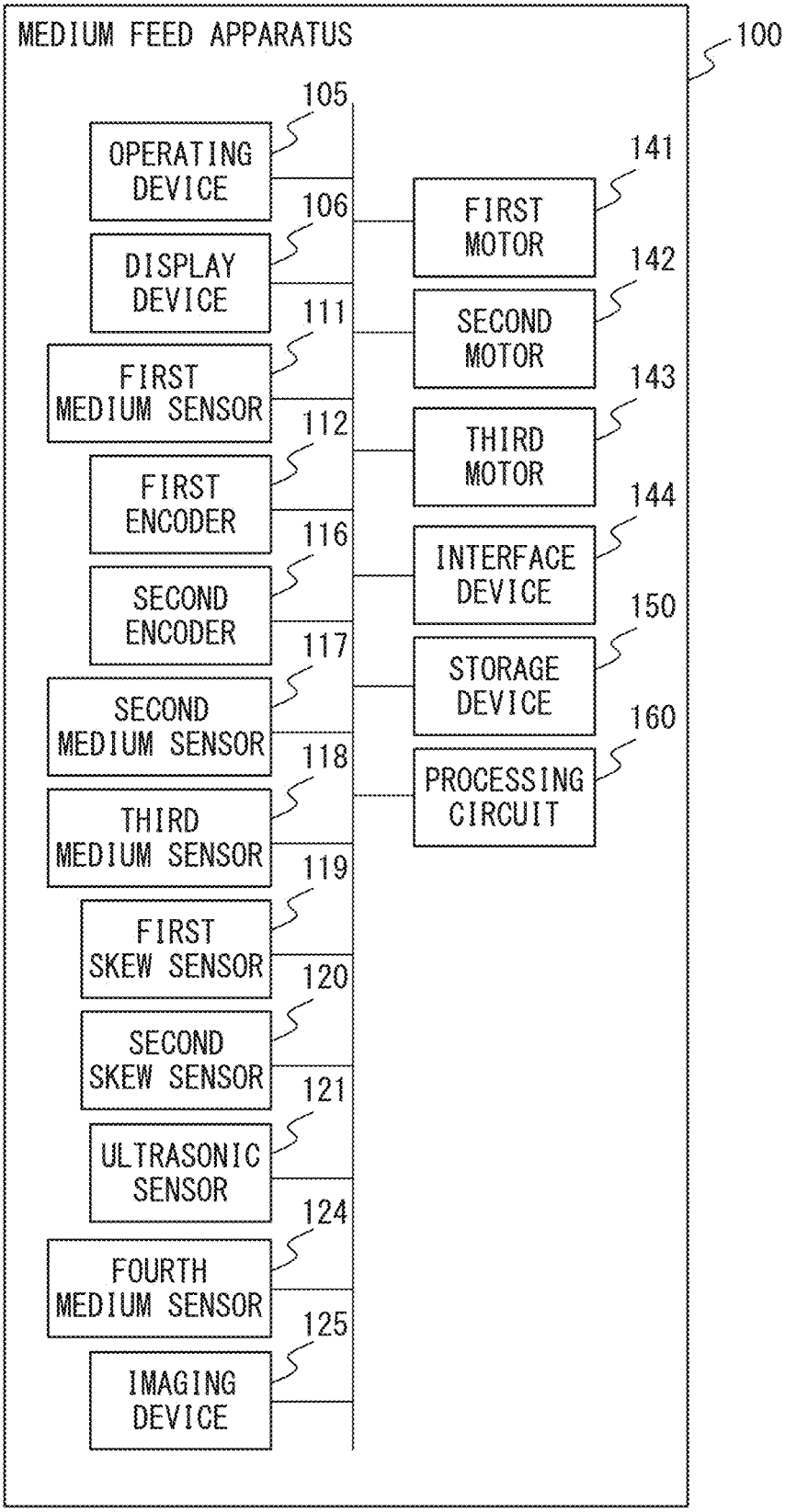
FIG. 4 is a block diagram illustrating a schematic constitution of an example of a medium feed apparatus.

FIG. 4 is a block diagram illustrating the schematic constitution of an example of a medium feed apparatus.

In addition to the above-mentioned constitution, the medium feed apparatus 100 further has a first motor 141, second motor 142, third motor 143, interface device 144, storage device 150, processing circuit 160, etc.

The first motor 141 includes one or more motors. The first motor 141 uses control signals from the processing circuit 160 to generate drive force for rotating the feed roller 114 in the medium feed direction A12 to feed the medium. If a plurality of feed rollers 114 are provided, each feed roller 114 is provided with a separate motor such that the feed rollers 114 independently rotate. Note that, the feed rollers 114 may be provided to rotate integrally by a common motor.

The second motor 142 is one example of a motor. The second motor 142 includes one or more motors. The second motor 142 uses control signals from the processing circuit 160 to generate drive force for rotating the separation roller 115 in the direction A13 opposite to the medium feed direction to separate the medium.

The third motor 143 includes one or more motors. The third motor 143 uses control signals from the processing circuit 160 to rotate the pick roller 113 and the first to sixth conveyance rollers 122*a* to 122*f* for conveying the medium. Note that, the first to sixth driven rollers 123*a* to 123*f* may be provided so as not driven by the first to sixth conveyance rollers 122*a* to 122*f*, but to rotate with the drive force of the third motor 143. Further, the third motor 143 uses control signals from the processing circuit 160 to move the stacking tray 103, swing the separation roller 115, or move the pick roller 113.

The interface device 144 has an interface circuit based on, for example a Universal Serial Bus (USB) or other serial bus and is electrically coupled with an information processing apparatus (for example, a personal computer, mobile information terminal, etc.) to send and receive input images and various information. Further, instead of the interface device 144, a communication device having an antenna sending and receiving wireless signals and a wireless communication interface circuit for transmitting and receiving signals through a wireless communication line in accordance with a predetermined communication protocol may be used. The predetermined communication protocol is for example a wireless Local Area Network (LAN). The communication device may also have a wired communication interface circuit for sending and receiving signals through a wired communication line in accordance with a wired LAN or other communication protocol.

The storage device 160 has a Random Access Memory (RAM), Read Only Memory (ROM), or other memory device, hard disk or other fixed disk device, flexible disk, optical disk, or other portable storage device, etc. Further, the storage device 150 stores computer programs, databases, tables, etc., used for various processing of the medium feed apparatus 100. The computer programs may be installed on the storage device 140 from a computer-readable, non-transitory medium such as a Compact Disc ROM (CD-ROM), Digital Versatile Disc ROM (DVD-ROM, etc., by using a well-known setup program etc. The computer programs may be installed on the storage device 140 from a server, etc.

The processing circuit 160 operates based on programs stored in advance in the storage device 150. The processing circuit is, for example, a Central Processing Unit (CPU). As the processing circuit 160, a Digital Signal Processor (DSP), Large Scale Integrated Circuit (LSI), Application Specific Integrated Circuit (ASIC), Field-Programmable Gate Array (FPGA), etc., may be used.

The processing circuit 160 is coupled with the operating device 105, display device 106, first medium sensor 111, first encoder 112, second encoder 116, second medium sensor 117, third medium sensor 118, first skew sensor 119, second skew sensor 120, ultrasonic sensor 121, fourth medium sensor 124, imaging device 125, first motor 141, second motor 142, third motor 143, interface device 1444, storage device 150, etc., and control these parts. The processing circuit 160 controls the drive of the first motor 141, second motor 142, and third motor 143 and controls imaging by the imaging device 125, etc., based on the signals received from the sensors. The processing circuit 160 acquires input images from the imaging device 125 and sends them to the information processing apparatus through the interface device 144.

Figure 5:
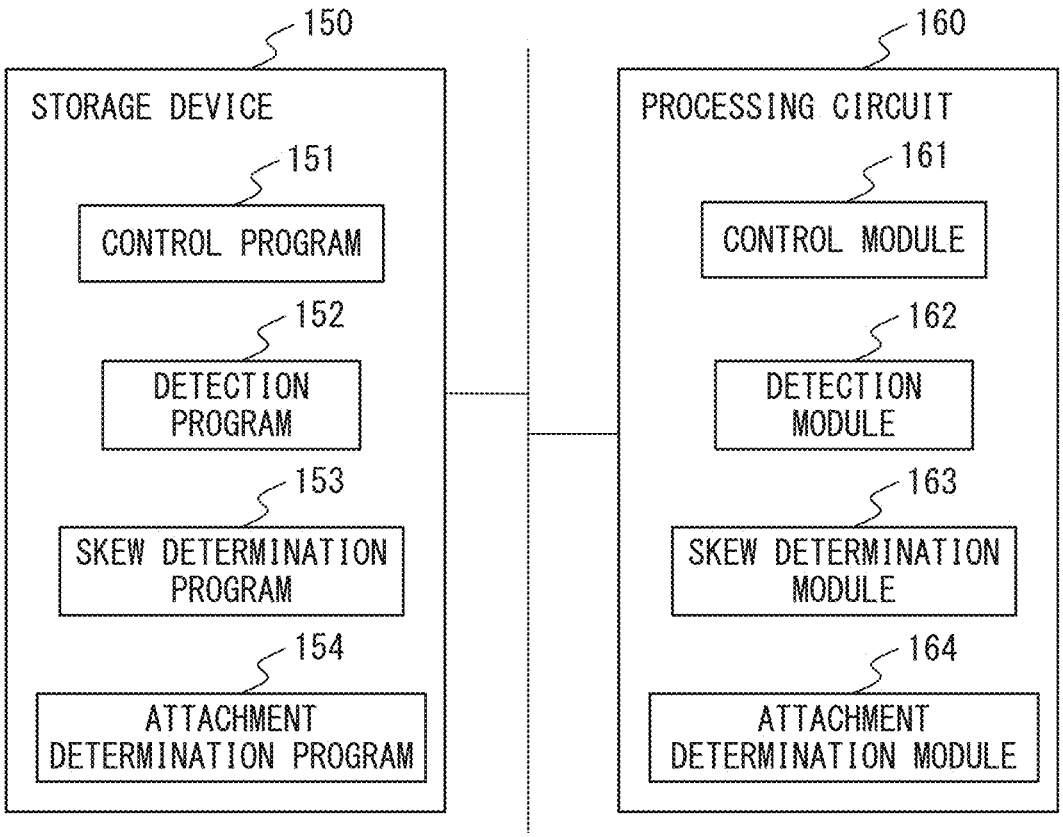
FIG. 5 is a view illustrating the schematic constitutions of a storage device 150 and processing circuit 160.

FIG. 5 is a view illustrating the schematic constitution of an example of a storage device and an example of a processing circuit.

As illustrated in FIG. 5, the storage device 150 stores a control program 151, detection program 152, skew determination program 153, attachment determination program 154, etc. These programs are function modules loaded by software operating on a processor. The processing circuit 160 reads the programs stored in the storage device 150 and operates in accordance with the read programs. Therefore, the processing circuit 160 functions as a control module 161, detection module 162, skew determination module 163, and attachment determination module 164.

Figure 6:
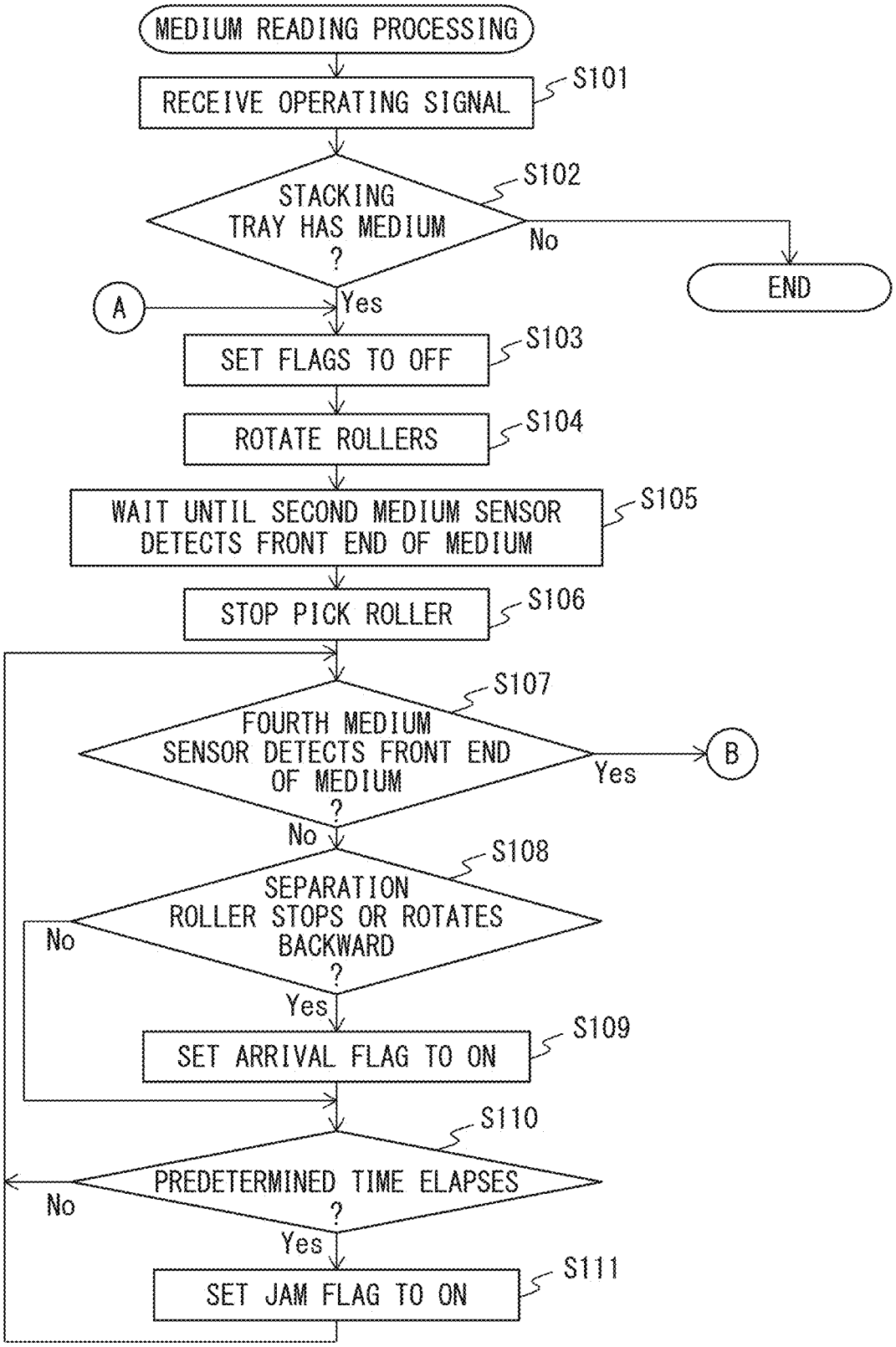
FIG. 6 is a flow chart presenting an example of operations in medium reading processing.
Figure 7:
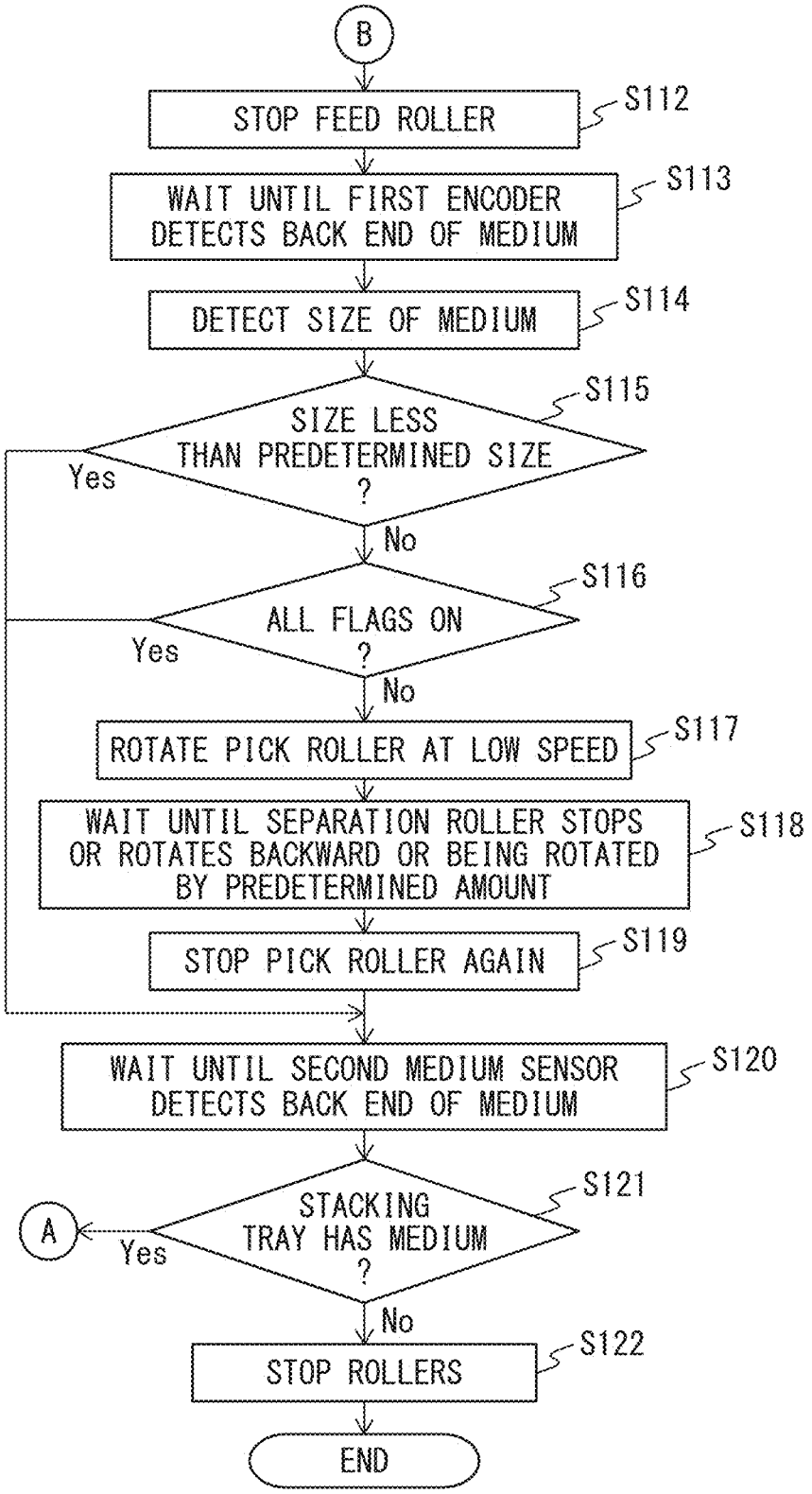
FIG. 7 is a flow chart presenting an example of operations in medium reading processing.

FIG. 6 and FIG. 7 are flow charts presenting an example of the operations in an example of a medium reading processing of an example of a medium feed apparatus 100.

An example of the operations in an example of a medium reading processing of an example of a medium feed apparatus will be explained below in reference to the flow charts presented in FIG. 7 and FIG. 8. Note that, the flow of the operations explained below is performed, based on a program stored in advance in the storage device 150, mainly by the processing circuit 160 in cooperation with the elements of the medium feed apparatus 100. Note that, in this flow chart, the feed mode is set to the separation mode.

First, the control module 161 waits until an instruction to read a medium is input by a user using the operating device 105 or an information processing apparatus and receiving an operating signal instructing reading of the medium from the operating device 105 or interface device 144 (step S101).

Next, the control module 161 acquires a medium signal from the first medium sensor 111 and determines whether the stacking tray 103 has the medium based on the acquired medium signal (step S102). If the stacking tray 103 does not have the medium, the control module 161 ends the series of processing.

On the other hand, if the stacking tray 103 has the medium, the control module 161 sets the arrival flag, jam flag, and skew flag to OFF (step S103). The arrival flag is set to OFF every time the medium is fed and is set to ON when, in the later explained processing, it is determined that a front end of the medium succeeding the medium being fed has reached the separation part. The jam flag is set to OFF every time the medium is fed and is set to ON when, in the later explained processing, it is determined that jam of the medium has occurred. The skew flag is set to OFF every time the medium is fed and is set to ON when, in the later explained skew determination processing, it is determined that skew of the medium has occurred, and skew of the medium is corrected.

Next, the control module 161 drives the third motor 143 to move the stacking tray 103 to a position where the medium stacked on the stacking tray 103 can be fed. The control module 161 drives the third motor 143 to rotate the pick roller 113 in the medium feed direction A11 and drives the first motor 141 to rotate the feed roller 114 in the medium feed direction A12 for feeding the medium stacked on the stacking tray 103. The control module 161 drives the third motor 143 to rotate the first to sixth conveyance rollers 122*a* to 122*f* for conveying the medium stacked on the stacking tray 103. Furthermore, the control module 161 controls the second motor 142 to generate a drive force rotating the separation roller 115 in the direction A13 opposite to the medium feed direction (step S104). Hereinafter, the drive force for rotating the separation roller 115 in the direction A13 opposite to the medium feed direction will sometimes be referred to as the "separation drive force".

Note that, the control module 161 may control the second motor 142 to put the separation roller 115 on hold. In this case, the control module 161 controls the second motor 142 to put the separation roller 115 on hold (holding a stopped state) while powering. In this case, the control module 161 controls the second motor 142 to generate a separation drive force to rotate the separation roller 115 in the direction A13 opposite to the medium feed direction when the second medium sensor 117 detects a front end of the medium.

Even if the separation roller 115 rotates in the direction A13 opposite to the medium feed direction right after starting feed of the medium, the medium waiting at the separation part is pushed out by the pick roller 113 and the feed roller 114 in the medium conveyance direction A2 and is pushed back by the separation roller 115. Due to this, the medium waiting at the separation part repeatedly moves forward and backward and the front end of the medium easily rises up causing buckling or jamming of the medium. Further, the separation roller 115 is given a force pushed downward by the pick roller 113 and the feed roller 114 through the medium waiting at the separation part. If the separation roller 115, which is swingable in the direction A13 opposite to the medium feed direction and supported by the arm 115*a*, is given a force, which rotate the separation roller 115 in the direction A13 opposite to the medium feed direction, a downward moment will act on the separation roller 115 and the force pressing the separation roller 115 downward will increase. Due to this downward pressing force and upward biasing force by the biasing member through the arm 115*a*, the separation roller 115 vibrates in the height direction A1 and multi-feed of the medium (avalanching to downstream side of the separation part) more easily occurs. As opposed to this, the medium feed apparatus 100 can put the separation roller 115 on hold right after starting the feed of the medium to thereby keep jamming and multi-feed of the medium from occurring.

FIGS. 8A to 8C and FIGS. 9A to 9C are schematic views for explaining feed of the medium.

Figure 8A:
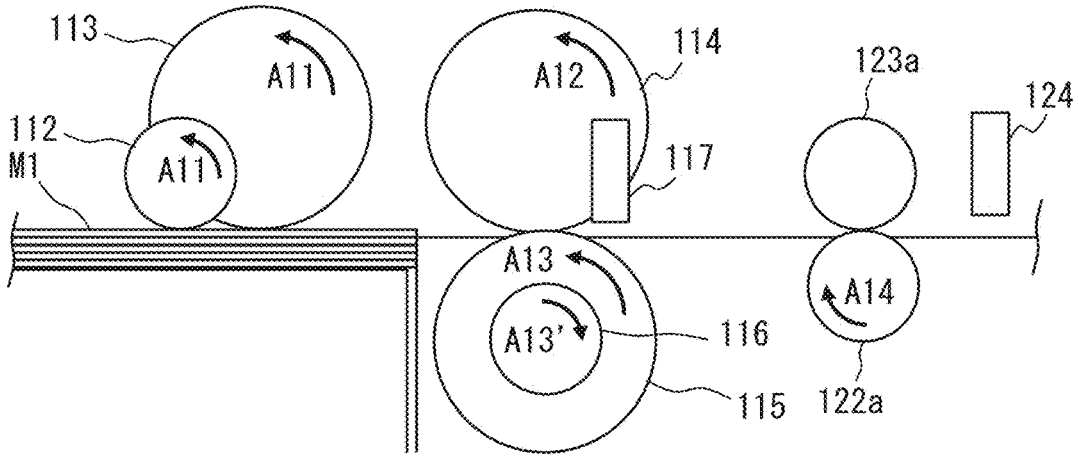
FIG. 8A is a schematic view for explaining feed of a medium.

FIG. 8A illustrates the state of the rollers right after start of feed of the medium. As illustrated in FIG. 8A, the pick roller 113, feed roller 114, and first conveyance roller 122*a* are controlled to rotate respectively in the medium feed directions A11, A12, and A14, the separation roller 115 is controlled to rotate in the direction A13 opposite to the medium feed direction. However, due to the action of the torque limiter provided at the separation roller 115, the drive force from the second motor 142 is cut off. The separation roller 115 does not rotate with the drive force from the second motor 142, but is rotated in the medium feed direction A13' by the feed roller 114.

Next, the control module 161 waits until the second medium sensor 117 detects a front end of the medium (step S105). The control module 161 periodically acquires a second medium signal from the second medium sensor 117. When the signal value of the second medium signal changes from a value indicating there is no medium to a value indicating there is the medium, the control module 161 determines that the second medium sensor 117 has detected a front end of the medium.

Next, the control module 161 controls the third motor 143 to stop the pick roller 113 (step S106). In other words, when the second medium sensor 117 detects the front end of a preceding sheet of the medium, the control module 161 stops the pick roller 113.

Figure 8B:
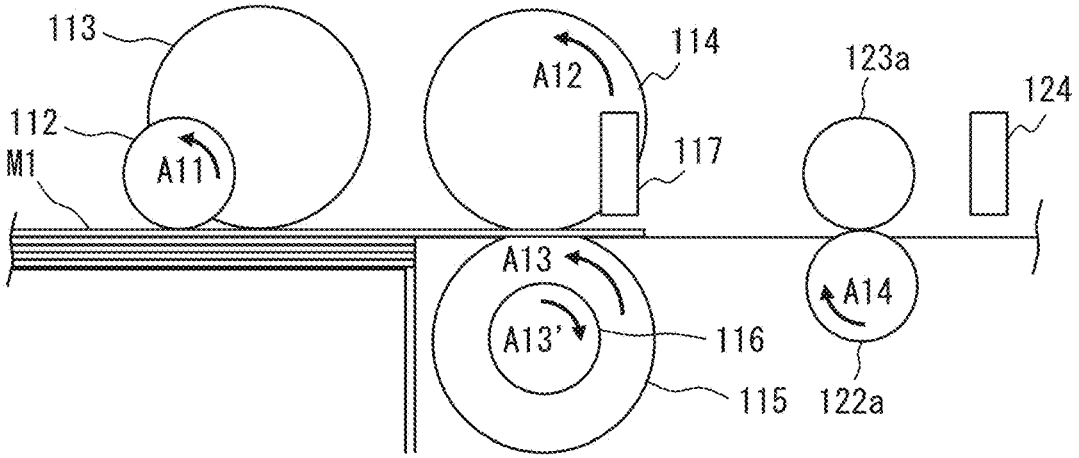
FIG. 8B is a schematic view for explaining feed of a medium.

FIG. 8B illustrates the state when a front end of the medium M1 placed at the top has passed the separation part. As illustrated in FIG. 8B, when the front end of the medium M1 has passed the separation part, the control module 161 stops the pick roller 113. At this time, there is only the medium M1 present between the feed roller 114 and the separation roller 115. Because of the torque limiter provided at the separation roller 115, the drive force from the second motor 142 is cut off. The separation roller 115 is rotated in the medium feed direction A13' by the feed roller 114. The medium M1 moves toward the downstream side due by the feed roller 114 and the separation roller 115 driven by to the feed roller 114. For this reason, the first encoder 112 continues to rotate in the medium feed direction A11.

Next, the control module 161 determines whether the fourth medium sensor 124 has detected the front end of the medium (step S107). The control module 161 periodically acquires a fourth medium signal from the fourth medium sensor 124. When the signal value of the fourth medium signal changes from a value indicating a state where there is no medium to a value indicating a state where there is the medium, it determines that the fourth medium sensor 124 has detected the front end of the medium.

If the fourth medium sensor 124 has still not detected a front end of the medium, the control module 161 determines whether the separation roller 115 stops or rotates in the direction A13 opposite to the medium feed direction (step S108). The control module 161 periodically receives a rotation signal from the second encoder 116. The control module 161 determines if the separation roller 115 stops or rotates in the direction A13 opposite to the medium feed direction by the rotation direction which the signal value of the received rotation signal indicates.

The control module 161 may determine that the separation roller 115 is rotating in the direction A13 opposite to the medium feed direction so long as the distance of movement indicated by the signal value of the received rotation signal, i.e., the distance of movement of the outer circumferential surface of the separation roller 115, is a predetermined distance or more. In this case, the control module 161 determines that the separation roller 115 is rotating in the direction A13 opposite to the medium feed direction so long as the total of the distances of movement when the signal value of the rotation signal indicates the separation roller 115 is rotating in the direction A13 opposite to the medium feed direction is a predetermined distance or more. Therefore, the control module 161 can keep a front end of the medium following the medium being fed from being mistakenly determined to have reached the separation module when a slight slip causes the separation roller 115 to rotate in the direction A13 opposite to the medium feed direction. If the separation roller 115 is not rotating in the direction A13 opposite to the medium feed direction, the control module 161 moves the processing to step S110 without performing any particular processing.

On the other hand, if the separation roller 115 is rotating in the direction A13 opposite to the medium feed direction, the control module 161 determines that the front end of the medium following the medium being fed has reached the separation part and sets the arrival flag to ON (step S109).

Next, the control module 161 determines whether a predetermined time has elapsed from when starting feed of the medium (step S110). The predetermined time is set in advance to the time taken for a front end of the medium to move from the position of the downstream end of the stacking tray 103 to the position of the fourth medium sensor 124 plus a certain margin. If the predetermined time has not elapsed from when starting feed of the medium, the control module 161 moves the processing to step S107 without performing any particular processing.

On the other hand, if the predetermined time has elapsed from when starting feed of the medium, the control module 161 determines that the medium has not been conveyed to the position of the first conveyance roller 122*a* within the predetermined time and that the medium has jammed and sets the jam flag to ON (step S111).

On the other hand, if the fourth medium sensor 124 detects a front end of the medium at step S107, the control module 161 controls the first motor 141 to stop the feed roller 114 (step S112). After that, the medium is conveyed by the first conveyance roller 122*a* and the first driven roller 123*a*. By stopping the feed roller 114 after the medium passes the position of the first conveyance roller 122*a*, the control module 161 can keep the medium from being pushed out and bent by the feed roller 114 or from being pulled and damaged by the feed roller 114.

Next, the control module 161 waits until the first encoder 112 detects a back end of the medium (step S113). The control module 161 periodically acquires a distance signal from the first encoder 112 and determines that the first encoder 112 has detected a back end of the medium when the signal value of the distance signal changes from a value indicating the medium is moving to a value indicating the medium is not moving.

Figure 8C:
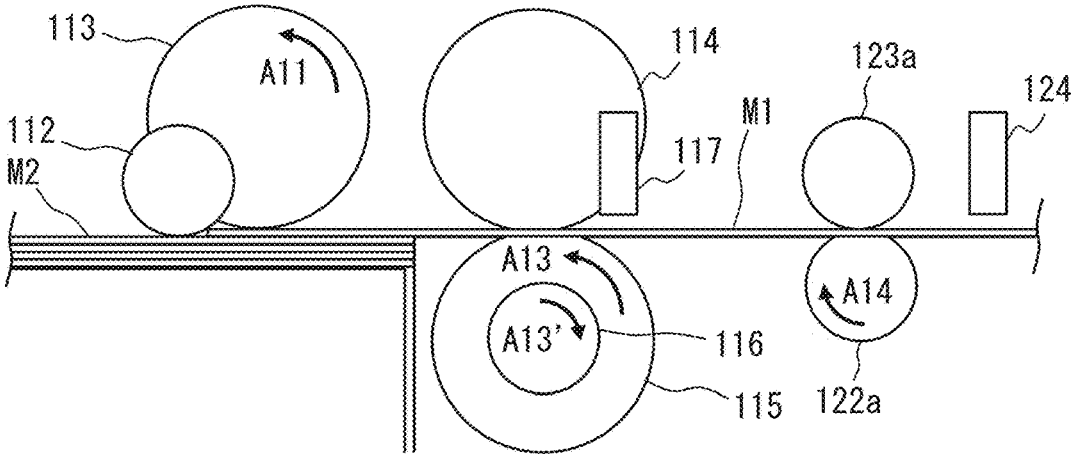
FIG. 8C is a schematic view for explaining feed of a medium.

FIG. 8C illustrates the state when a back end of the medium M1 placed at the top and being fed passes the position of the first encoder 112. As illustrated in FIG. 8C, if the back end of the medium M1 passes the position of the first encoder 112, the first encoder 112 moves away from the medium M1 and contacts the medium M2 placed below the medium M1. At this time, the pick roller 113 and the feed roller 114 are stopped and the medium M2 is not fed (does not move), so the first encoder 112 stops. By detecting the stopping of the first encoder 112, the control module 161 can detect the back end of the medium being fed passing the position of the first encoder 112.

Next, the detection module 162 detects the size of the medium (step S114). The detection module 162 detects the size of the preceding sheet of the medium being fed in the medium conveyance direction A2 based on the drive amount of the first motor 141 from when a front end of the medium passes the position of the second medium sensor 117 to when the back end of the medium passes the position of the first encoder 112. The detection module 162 detects the size of the medium as the total of the distance of movement of the outer circumferential surface of the feed roller 114 moved when driving the first motor 141 by the above drive amount and the distance between the second medium sensor 117 and the first encoder 112. The detection module 162 may also determine whether the size of the medium is less than a predetermined size by whether the back end of the medium has passed the position of the first encoder 112 while the front end of the medium has advanced by a predetermined distance (for example, 60 mm) after passing the position of the second medium sensor 117. The predetermined size is the total of the predetermined distance and the distance between the second medium sensor 117 and the first encoder 112. The predetermined size is, for example, set to the length of the longitudinal direction of an A7 size, the length of the longitudinal direction of an A8 size, etc.

Next, the control module 161 determines whether the size of the preceding sheet of the medium detected by the detection module 162 is less than the predetermined size (step S115). If the size of the preceding sheet of the medium detected is less than the predetermined size, the control module 161 moves the processing to step S120 without performing the processing of steps S117 to S119. In other words, if the size of the preceding sheet of the medium detected is less than the predetermined size, the control module 161 does not rotate the pick roller 113 rotate again when the first encoder 112 detects the back end of the preceding sheet of the medium.

A small size medium can be fed by a small force, so there is a high possibility of the medium not contacting the pick roller 113 but located below the medium being fed is also conveyed to right before the nip part of the separation part before being fed. The medium which has been conveyed to right before the nip part of the separation part before being fed is fed (passes the separation part) in a short time. Therefore, when feeding a small size medium, there is a high possibility that the medium feed apparatus 100 can feed the succeeding sheet of the medium in a sufficiently short time without starting the feed of the succeeding sheet of the medium before the back end of the preceding sheet of the medium passes the separation part. Further, a small size medium is light, so if the front end of the succeeding sheet of the medium strikes the nip part of the separation part during separation of the preceding sheet of the medium, there is a possibility of the medium jamming. In general, when a plurality of sheets of the medium are conveyed all together, the size of each medium is likely to be the same. If the preceding sheet of the medium is a small size medium, the control module 161 can refrain from starting the feed of the succeeding sheet of the medium before the back end of the preceding sheet of the medium passes the separation part so as to feed the succeeding sheet of the medium in a sufficiently short time while reducing the possibility of the medium jamming.

If the size of the preceding sheet of the medium is the predetermined size or more, the control module 161 determines whether any of the flags among the arrival flag, the jam flag, and the skew flag has been set to ON (step S116). If any of the flags among the arrival flag, the jam flag, and the skew flag has been set to ON, the control module 161 moves the processing to step S120.

If the arrival flag is set to ON, i.e., if the front end of the succeeding sheet of the medium reaches the nip part of the separation part, the control module 161 does not rotate the pick roller 113 again when the first encoder 112 detects the back end of the preceding sheet of the medium. In other words, if the second encoder 116 detects the separation roller 115 stops or rotates in the direction A13 opposite to the medium feed direction, the control module 161 does not rotate the pick roller 113 again when the first encoder 112 detects the back end of the preceding sheet of the medium. In this way, the control module 161 can keep the succeeding sheet of the medium M2 from being pushed out too much by the pick roller 113 and keep multi-feed of the medium, buckling, or jamming from occurring.

If the jam flag is set to ON, i.e., if jam of the preceding sheet of the medium has occurred, the control module 161 does not rotate the pick roller 113 again when the first encoder 112 detects the back end of the preceding sheet of the medium. In this way, the control module 161 can keep the succeeding sheet of the medium from jamming after the preceding sheet of the medium jams and keep the medium from being damaged.

If the skew flag is set to ON, i.e., if skew of the preceding sheet of the medium has occurred, the control module 161 does not rotate the pick roller 113 again when the first encoder 112 detects the back end of the preceding sheet of the medium. In this way, the control module 161 can keep correction of skew by the feed roller 114 from being impeded by the succeeding sheet of the medium reaching the separation part.

On the other hand, if all of the arrival flag, the jam flag, and the skew flag are set to OFF, the control module 161 controls the third motor 143 to rotate the pick roller 113 again (step S117). In other words, when the first encoder 112 detects the back end of the preceding sheet of the medium, the control module 161 rotates the pick roller 113 again to advance the succeeding sheet of the medium.

Figure 9A:
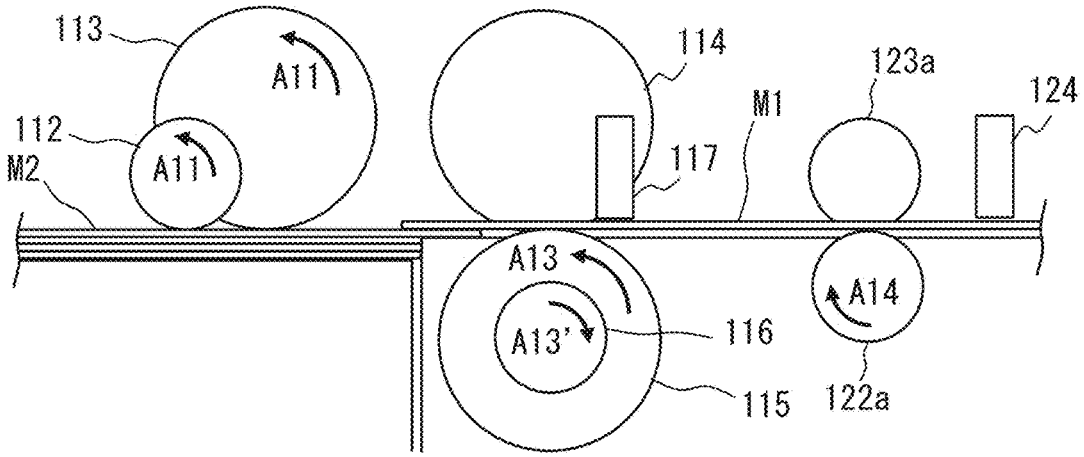
FIG. 9A is a schematic view for explaining feed of a medium.

FIG. 9A illustrates the state after the back end of the medium M1 placed at the top and being fed passed the position of the first encoder 112. As illustrated in FIG. 9A, by rotating the pick roller 113 again when the back end of the medium M1 passes the position of the first encoder 112 (before passing the separation part), the succeeding sheet of the medium M2 advances toward the separation part together with the preceding sheet of the medium M1. The control module 161 can advance the succeeding sheet of the medium M2 toward the separation part before the back end of the preceding sheet of the medium M1 passes the separation part so as to feed the succeeding sheet of the medium M2 in a shorter time.

The control module 161 sets the rotational speed of the pick roller 113 at the time of rotating the pick roller 113 again when the first encoder 112 detects the back end of the preceding sheet of the medium to a speed lower than the rotational speed of the pick roller 113 at the time of starting feed of the preceding sheet of the medium. The control module 161 can lower the speed for advancing the succeeding sheet of the medium to thereby keep the front end of the succeeding sheet of the medium from strongly striking the separation part and keep the medium from jamming during feed of the preceding sheet of the medium. Note that, the control module 161 may set the rotational speed of the pick roller 113 when the first encoder 112 detects the back end of the medium to the same speed as the rotational speed of the pick roller 113 when starting feed of the medium.

Next, the control module 161 waits until the second encoder 116 detects the separation roller 115 stops or rotates in the direction A13 opposite to the medium feed direction or until the third motor 143 rotates a predetermined amount from when the pick roller 113 is rotated again (step S118). The predetermined amount is set in advance by prior experiments to the amount of rotation required for moving the medium from the downstream end of the stacking tray 103 to the nip part of the separation part. The control module 161 determines if the separation roller 115 stops or rotates in the direction A13 opposite to the medium feed direction in the same way as the processing of step S108.

Next, the control module 161 controls the third motor 143 to stop the pick roller 113 again (step S119). In other words, when the second encoder 116 detects the separation roller 115 stops or rotates in the direction A13 opposite to the medium feed direction after rotating the pick roller 113 again, the control module 161 stops the pick roller 113 again to stop advancing the succeeding sheet of the medium.

Figure 9B:
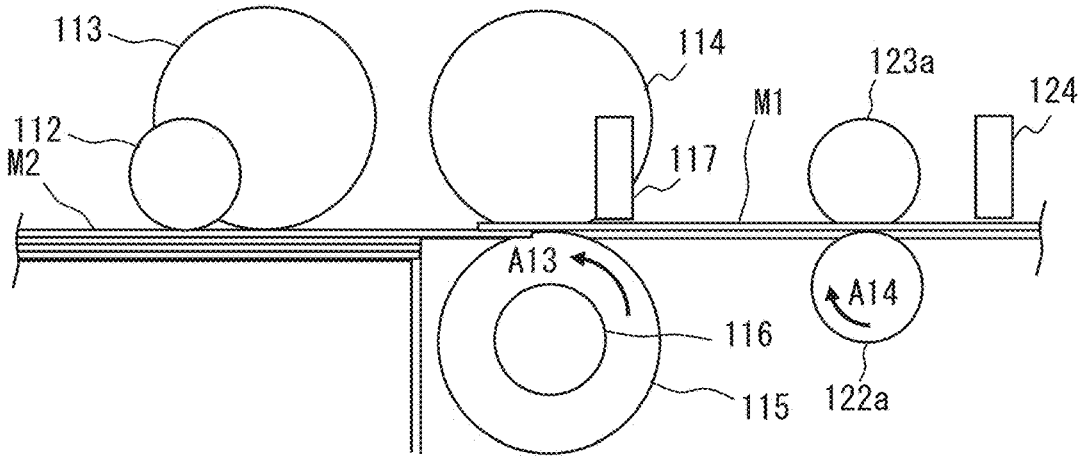
FIG. 9B is a schematic view for explaining feed of a medium.

FIG. 9B illustrates the state where the front end of the succeeding sheet of the medium M2 reaches the separation part from the state illustrated in FIG. 9A. As illustrated in FIG. 9B, if the front end of the sheet of the medium M2 reaches the separation part, there will be two sheets of the medium of the preceding sheet of the medium M1 and the succeeding sheet of the medium M2 between the feed roller 114 and the separation roller 115. For this reason, the separation drive force from the second motor 142 is transmitted to the separation roller 115, and the separation roller 115 stops or rotates in the direction A13 opposite to the medium feed direction. The control module 161 can stop the pick roller 113 again at this timing to stop advancing the succeeding sheet of the medium M2 such that the succeeding sheet of the medium M2 waits right before the separation part. Therefore, the medium feed apparatus 100 can feed the succeeding sheet of the medium M2 in a shorter time after finishing feed of the preceding sheet of the medium M1.

In this way, the control module 161 stops the pick roller 113 again when the second encoder 116 detects the separation roller 115 stops or rotates in the direction A13 opposite to the medium feed direction. By using the second encoder 116 to monitor rotation of the separation roller 115, the control module 161 can immediately and reliably detect that the succeeding sheet of the medium M2 reaches the separation part. In this way, the control module 161 can keep the succeeding sheet of the medium M2 from being pushed out by the pick roller 113 and multi-feed of the medium, buckling, or jamming from occurring.

Further, the control module 161 rotates the pick roller 113 again when the third motor 143 has rotated a predetermined amount after starting rotation of the pick roller 113 again, i.e., when a predetermined time has elapsed. By monitoring the amount of rotation of the third motor 143 (or time elapsed), the control module 161 can suitably stop the succeeding sheet of the medium M2 even when the separation roller 115 is rotated by the medium regardless of the succeeding sheet of the medium M2 reaching the separation part.

Next, the control module 161 waits until the second medium sensor 117 detects a back end of the medium (step S120). The control module 161 periodically acquires a second medium signal from the second medium sensor 117. If the signal value of the second medium signal changes from a value indicating a state where there is the medium to a value indicating a state where there is no medium, it determines that the second medium sensor 117 has detected the back end of the medium. The control module 161 determines whether the second medium sensor 117 has detected the back end of the medium so as to determine whether the back end of the medium being fed has passed the nip part of the feed roller 114 and the separation roller 115. In other words, the control module 161 determines whether the back end of the preceding sheet of the medium M1 has passed the feed roller 114 and the separation roller 115 after stopping the pick roller 113 again.

Next, the control module 161 determines whether the stacking tray 103 has the medium based on a medium signal received from the first medium sensor 111 (step S121). If the stacking tray 103 has the medium, the control module 161 returns the processing to step S103 and repeats the processing of step S103 and so on. The control module 161 successively feeds the plurality of sheets of the medium stacked on the stacking tray 103 by repeating the processing of steps S103 to S121.

In this case, at step S104, the control module 161 drives the third motor 143 and the first motor 141 to rotate the pick roller 113 and the feed roller 114 respectively in the medium feed directions A11 and A12 to feed the medium stacked on the stacking tray 103. In other words, the control module 161 rotates the pick roller 113 again to feed the succeeding sheet of the medium M2 when the back end of the preceding sheet of the medium M1 passes the feed roller 114 and the separation roller 115.

Figure 9C:
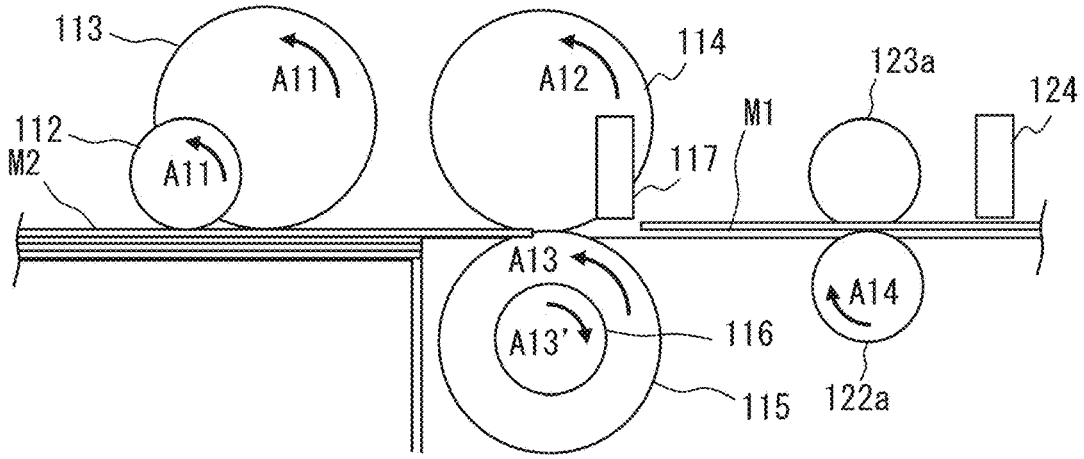
FIG. 9C is a schematic view for explaining feed of a medium.

FIG. 9C illustrates the state of the back end of the preceding sheet of the medium M1 passing the separation part from the state illustrated in FIG. 9B. As illustrated in FIG. 9C, if the back end of the preceding sheet of the medium M1 passed the separation part, the control module 161 rotates the pick roller 113 and the feed roller 114 again to feed the succeeding sheet of the medium M2. In this way, the control module 161 can move the succeeding sheet of the medium M2 away from the preceding sheet of the medium M1 to suitably hold the distance from the preceding sheet of the medium M1 while feeding in a shorter time.

The control module 161 sets the rotational speed of the pick roller 113 at the time of rotating the pick roller 113 again when the back end of the preceding sheet of the medium passes the feed roller 114 and the separation roller 115 to a speed higher than the rotational speed of the pick roller 113 at the time of rotating the pick roller 113 again at step S117 when the first encoder 112 detects the back end of the preceding sheet of the medium. The control module 161 can raise the speed of advancing the succeeding sheet of the medium after finishing feed of the preceding sheet of the medium to thereby decreasing the time required for feeding the succeeding sheet of the medium and the time required for the medium conveying. Note that, the control module 161 may set the rotational speed of the pick roller 113 at the time when a back end of the medium passes the feed roller 114 and the separation roller 115 to the same speed as the rotational speed of the pick roller 113 at the time when the first encoder 112 detects a back end of the medium.

On the other hand, if the stacking tray 103 does not have any medium, the control module 161 controls the second motor 142 to stop the separation roller 115 and controls the third motor 143 to stop the first to the sixth conveyance rollers 122*a* to 122*f* (step S122), and ends the series of steps.

If the feed mode is set to the nonseparation mode, the processing of steps S103, S108 to S111, and S113 to S121 is omitted. In this case, the control module 161 controls the separation roller 115 to be rotated by the feed roller 114 at steps S105.

Note that, the processing of steps S108 to S109 or S114 to S115 may also be omitted.

Further, the control module 161 may receive from the user a setting of whether to start the feed of the succeeding sheet of the medium before the back end of the preceding sheet of the medium passes the separation part. In this case, the control module 161 receives a setting input by the user using the operating device 105 or an information processing apparatus from the operating device 105 or the interface device 144. When set so as not to start the feed of the succeeding sheet of the medium before the back end of the preceding sheet of the medium passes the separation part, the control module 161 omits the processing of steps S108 to S111 and S113 to S119. The user can select whether reducing the time required for conveyance of the medium or suppressing occurrence of multi-feed of the medium in accordance with the application or the type of the medium, etc. The medium feed apparatus 100 can therefore improve user friendliness.

Further, if it is detected that the separation roller 115 stops or rotates in the direction A13 opposite to the medium feed direction at step S108 or S118, the control module 161 may change the pressing force at which the separation roller 115 presses the feed roller 114. For example, the control module 161 controls the third motor 143 to increase the pressing force at which the separation roller 115 presses the feed roller 114. In this way, the control module 161 can increase the frictional force generated between the succeeding sheet of the medium and the separation roller 115 and can keep the succeeding sheet of the medium from being fed to the downstream side of the separation part.

In this case, after step S120 where the second medium sensor 117 detects a back end of the medium, the control module 161 may return the pressing force at which the separation roller 115 presses the feed roller 114 at step S104. For example, the control module 161 controls the third motor 143 to reduce the pressing force at which the separation roller 115 presses the feed roller 114. In this way, the control module 161 can keep the separation force of the medium by the feed roller 114 and the separation roller 115 from being increased and multi-feed of the medium from occurring.

Figure 10:
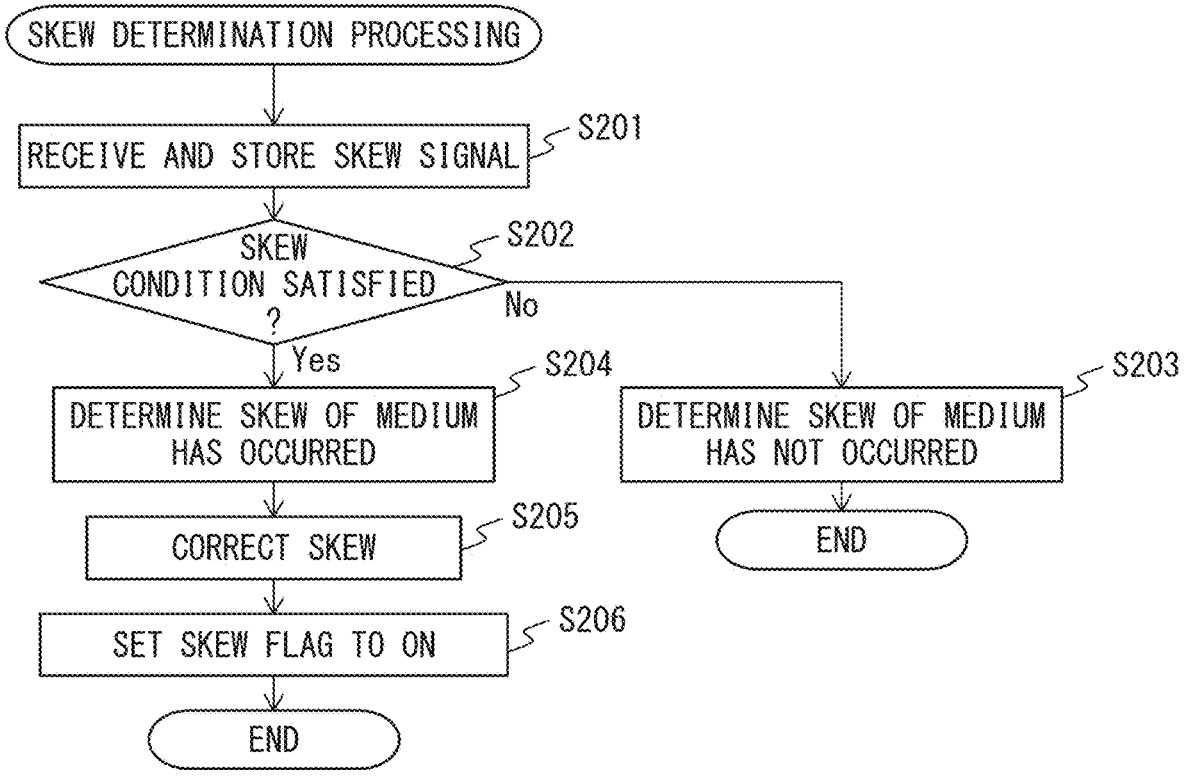
FIG. 10 is a flow chart presenting an example of operations in skew determination processing.

FIG. 10 is a flow chart presenting an example of operations in skew determination processing of the medium feed apparatus 100.

Figure 11:
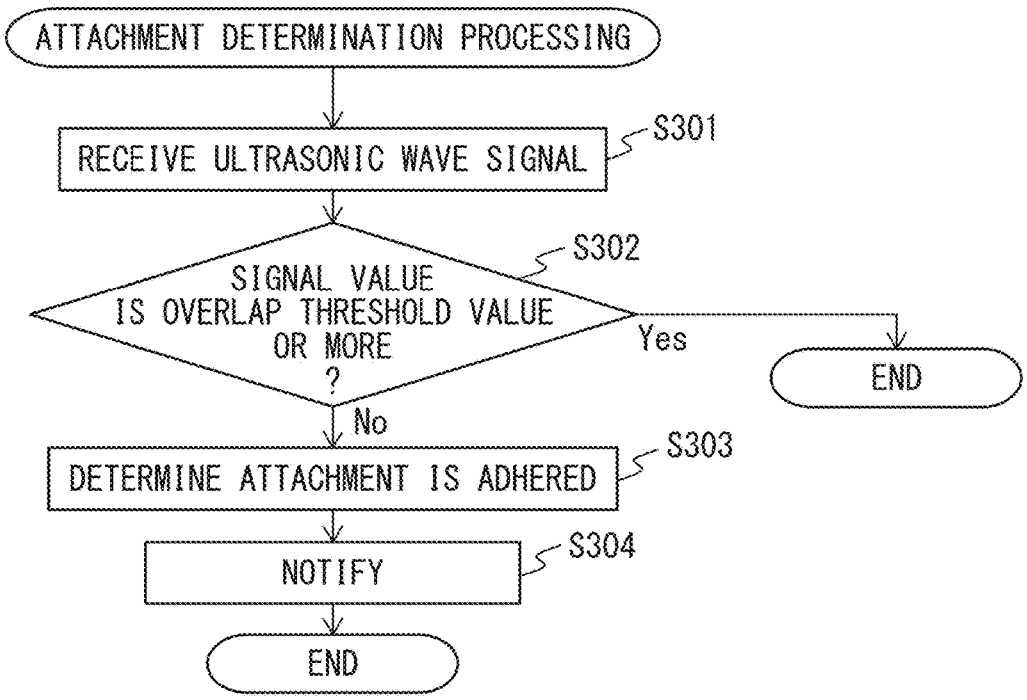
FIG. 11 is a flow chart presenting an example of operations in attachment determination processing.

An example of operations in the skew determination processing of the medium feed apparatus 100 will be explained below in reference to the flow chart presented in FIG. 10. Note that, the flow of operations explained below is performed, based on a program stored in advance in the storage device 150, mainly by the processing circuit 160 in cooperation with elements of the medium feed apparatus 100. The flow of operations presented in FIG. 11 is periodically performed while conveying the medium.

First, the skew determination module 162 receives the first skew signal and the second skew signal respectively from the first skew sensor 119 and the second skew sensor 120 and stores the signal values of the received skew signals in the storage device 150 (step S201).

Next, the skew determination module 162 determines whether a skew condition has been satisfied (step S202). The skew determination module 162 determines whether a front end of the medium has reached the positions of the first skew sensor 119 and the second skew sensor 120. The skew determination module 162 determines that a front end of the medium has reached the position of the first skew sensor 119 when the signal value of the first skew signal changes from a value indicating there is no medium to a value indicating there is the medium. Further, the skew determination module 162 determines that a front end of the medium has reached the position of the second skew sensor 120 when the signal value of the second skew signal changes from a value indicating there is no medium to a value indicating there is the medium. The skew determination module 162 determines that the skew condition has been satisfied if a front end of the medium reaches one position of the first skew sensor 119 and the second skew sensor 120, then does not reach the other position within a third predetermined time. The third predetermined time is set to the average value, center value, minimum value, maximum value, etc., of the difference in points of time when the medium passes the skew sensors when jamming of the medium occurs or dropping of parts of the input image in the medium occurs based on, for example, experiments performed in advance by conveying the medium slanted.

If the skew condition has not been satisfied, the skew determination module 162 determines that skew of the medium has not occurred (step S203) and ends the series of steps. On the other hand, if the skew condition has satisfied, the skew determination module 162 determines that skew of the medium has occurred (step S204).

Next, if skew of the medium has occurred, the control module 161 controls a plurality of feed rollers 114 to correct the skew of the medium (step S205). The control module 161 corrects skew of the medium by differentiating the peripheral speeds of the feed rollers 114 from each other. The control module 161 changes the peripheral speeds of the feed rollers 114 so that the peripheral speed of the feed roller 114 located at the side in the width direction A4 where progression of the medium is slow becomes faster (higher) than the peripheral speed of the feed roller 114 located at the preceding side. The control module 161 increases (raises) the peripheral speed of the feed roller 114 located at the side where progression of the medium is slow and/or decreases (lowers) the peripheral speed of the feed roller 114 located at the preceding side.

Next, the skew determination module 162 sets the skew flag to ON (step S206) and ends the series of steps.

As explained at step S116 of FIG. 7, if the skew flag is set to ON, the control module 161 does not rotate the pick roller 113 again when the first encoder 112 detects the back end of the preceding sheet of the medium. In this way, the control module 161 can keep correction of skew of the preceding sheet of the medium from being obstructed due to the succeeding sheet of the medium reaching the separation part.

FIG. 11 is a flow chart indicating an example of operations in the attachment determination processing of the medium feed apparatus 100.

Figure 12:
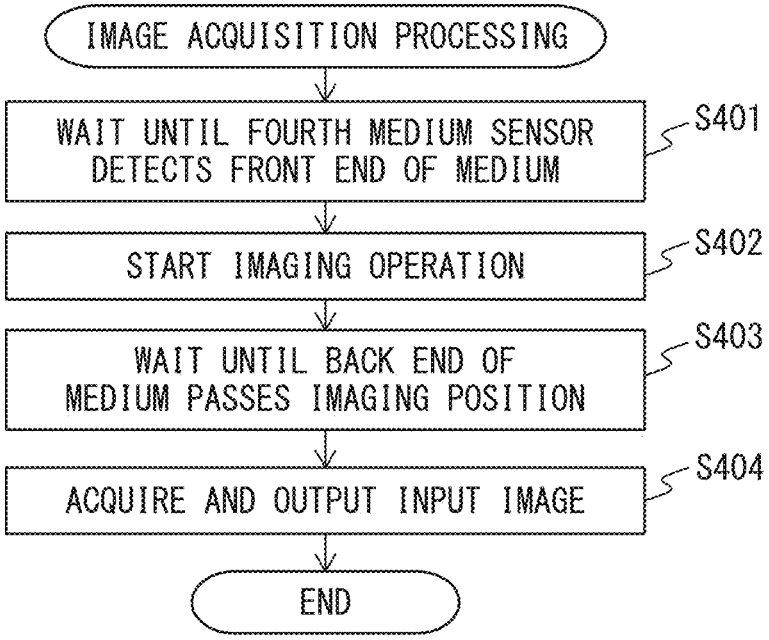
FIG. 12 is a flow chart presenting an example of operations in image acquisition processing.

An example of operations in the attachment determination processing of the medium feed apparatus 100 will be explained below in reference to the flow chart presented in FIG. 11. Note that, the flow of operations explained below is performed, based on a program stored in advance in the storage device 150, mainly by the processing circuit 160 in cooperation with the elements of the medium feed apparatus 100. The flow of operations presented in FIG. 12 is performed periodically during conveyance of the medium.

First, the attachment determination module 163 acquires an ultrasonic wave signal from the ultrasonic sensor 121 (step S301). Next, the attachment determination module 163 determines whether the signal value of the acquired ultrasonic wave signal is an overlap threshold value or more (step S302). The overlap threshold value is set to a value between the signal value of the ultrasonic wave signal when one sheet of paper is conveyed and the signal value of the ultrasonic wave signal when multi-feed of the paper occurs.

If the signal value of the ultrasonic wave signal is the overlap threshold value or more, the attachment determination module 163 ends the series of steps without performing any particular processing. On the other hand, if the signal value of the ultrasonic wave signal is less than the overlap threshold value, the attachment determination module 163 determines that the medium has a sticker or label (seal) or other attachment (step S303). Next, the attachment determination module 163 sends information indicating that the medium has an attachment through the interface device 144 to the information processing apparatus to thereby notify the user of it (step S304) and ends the series of steps. On the other hand, the attachment determination module 163 determines that the medium does not have an attachment if the signal value of the ultrasonic wave signal does not become less than the overlap threshold value before a back end of the medium passes the ultrasonic sensor 121.

In this way, the attachment determination module 163 determines whether the medium has an attachment based on the ultrasonic wave signal. During feed of the medium, the feed roller 114 is stopped at step S112 of FIG. 7. Further, if multi-feed of the medium has occurred, the separation roller 115 stops or rotates in the direction A13 opposite to the medium feed direction and the pick roller 113 is stopped at step S118 of FIG. 7. For this reason, even if overlap of the medium is detected by the ultrasonic sensor 121 located at the downstream side from the separation part, the possibility of multi-feed of the medium has occurred is low. Therefore, if the ultrasonic sensor 121 located at the downstream side from the separation part detects overlap of the medium, the medium feed apparatus 100 can identify that the medium has an attachment.

FIG. 12 is a flow chart presenting an example of the operations in image acquisition processing of the medium feed apparatus 100.

An example of the operations in the skew determination processing of the medium feed apparatus 100 will be explained below in reference to the flow chart presented in FIG. 12. Note that, the flow of the operations explained below is performed, based on a program stored in advance in the storage device 150, mainly by the processing circuit 160 in cooperation with the elements of the medium feed apparatus 100. The flow of operations presented in FIG. 12 is periodically performed during conveyance of the medium.

First, the control module 161 waits until the fourth medium sensor 124 detects a front end of the medium (step S401). The control module 161 periodically acquires a fourth medium signal from the fourth medium sensor 124. When the signal value of the fourth medium signal changes from a value indicating a state where there is no medium to a value indicating a state where there is a medium, the control module 161 determines that the fourth medium sensor 124 has detected the front end of the medium.

Next, the control module 161 controls the imaging device 125 to start image capture (step S402).

Next, the control module 161 waits until the back end of the medium passes the imaging position (step S403). For example, the control module 161 periodically acquires a fourth medium signal from the fourth medium sensor 124. When the signal value of the fourth medium signal changes from a value indicating a state where there is the medium present to a value indicating a state where there is no medium, it determines that the fourth medium sensor 124 has detected the back end of the medium. The control module 161 determines that the back end of the medium has passed the imaging position when a second predetermined time has elapsed from when the fourth medium sensor 124 detects the back end of the medium. The second predetermined time is set to the time taken for the medium to move from the fourth medium sensor 124 to the imaging position plus a certain margin.

Next, the control module 161 controls the imaging device 125 to end the imaging operation. The control module 161 acquires an input image from the imaging device 125 and outputs the acquired input image by sending the acquired input image through the interface device 144 to an information processing apparatus (step S404) and ends the series of steps.

As explained in detail above, the medium feed apparatus 100 stops the pick roller 113 once when the front end of a preceding sheet of the medium passes the separation part.

The medium feed apparatus 100 restart the rotation of the pick roller 113 when the back end of the preceding sheet of the medium passes the pick roller 113 to thereby advancing the next sheet of the medium until the front end of the succeeding sheet of the medium reaches the separation part. In this way, the medium feed apparatus 100 can suitably maintain the distance between the back end of the preceding sheet of the medium and the front end of the succeeding sheet of the medium while quickly starting feed of the succeeding sheet of the medium when the back end of the preceding sheet of the medium passes the separation part. Therefore, the medium feed apparatus 100 can keep multi-feed of the medium from occurring while decreasing the time required for feeding of the medium.

In particular, the medium feed apparatus 100 stops the pick roller 113 once when the front end of the preceding sheet of the medium passes the separation part. Because of this, if the sheet of the medium placed below the preceding sheet of the medium is formed with punch holes or other holes, the pick roller 113 is kept from contacting that sheet of the medium placed below through the holes and from feeding the sheet of the medium placed below. Further, the medium feed apparatus 100 can decrease unnecessary power consumption of the medium feed apparatus 100 by stopping the pick roller 113 once when the front end of the preceding sheet of the medium passes the separation part.

In general, the degree by which a preceding sheet of the medium drags a succeeding sheet of the medium changes depends on the type or state of the medium or the environment in which the medium feed apparatus 100 is set. For example, if the coefficient of friction between sheets of the medium is low, there is a low degree of the preceding sheet of the medium dragging the succeeding sheet of the medium and at the point of time when the back end of the preceding sheet of the medium passes the separation part, the front end of the succeeding sheet of the medium is located at a position away from the separation part. On the other hand, if the coefficient of friction between sheets of the medium is high, the degree by which a preceding sheet of the medium drags a succeeding sheet of the medium will be large and at the point of time when the back end of the preceding sheet of the medium passes the separation part, the front end of the succeeding sheet of the medium will be located at a position close to the separation part. The medium feed apparatus 100 rotates the pick roller 113 again when the back end of the preceding sheet of the medium passes the pick roller 113 to advance the next sheet of the medium before the front end of the succeeding sheet of the medium reaches the separation part. Due to this, regardless of the type or state of the medium or the environment in which the medium feed apparatus 100 is set, the medium feed apparatus 100 can make the front end of the succeeding sheet of the medium wait right before the nip part of the separation part at the point of time when the back end of the preceding sheet of the medium passes the separation part.

Further, even when the front ends of sheets of the medium set on the stacking tray 103 by the user are not aligned, the medium feed apparatus 100 can make the front end of the succeeding sheet of the medium wait right before the nip part of the separation part at the point of time when the back end of the preceding sheet of the medium passes the separation part. The user no longer need to carefully align the medium when setting a plurality of sheets of the medium on the stacking tray 103. The medium feed apparatus 100 can therefore improve user friendliness.

Further, the medium feed apparatus 100 can decrease the time required for feed of the medium without increasing the feed speed or conveyance speed of the medium. Therefore, the medium feed apparatus 100 can decrease the time required for feed of the medium while avoiding an increase in part costs due to use of high spec parts, an increase in cost of replacement parts due to reduction of the part durability, and an increase in power consumption of the apparatus.

Further, the medium feed apparatus 100 does not use an ultrasonic sensor or thickness sensor, etc., but uses the second encoder 116 detecting rotation of the separation roller 115 to determine whether the front end of the succeeding sheet of the medium has reached the position of the separation roller 115. For this reason, even if the preceding sheet of the medium has an attachment, the medium feed apparatus 100 does not mistakenly determine that the front end of the succeeding sheet of the medium has reached the position of the separation roller 115 but can determine with a high precision whether the front end of the succeeding sheet of the medium has reached the position of the separation roller 115.

Figure 13:
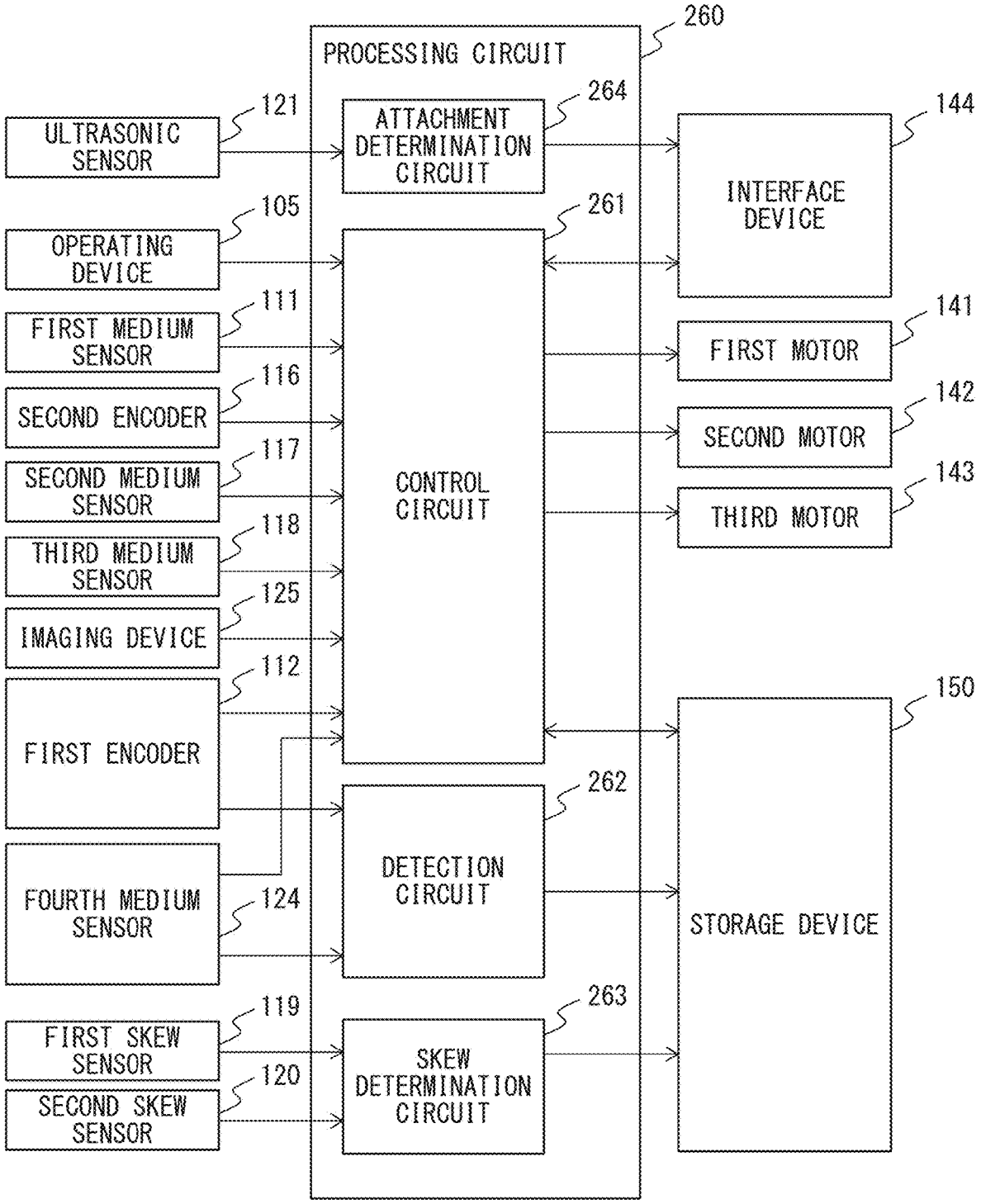
FIG. 13 is a view illustrating the schematic constitution of a processing circuit 260 according to another embodiment.

FIG. 13 is a view illustrating the schematic constitution of the processing circuit 260 of the medium feed apparatus according to an example of another embodiment.

The processing circuit 260 is used instead of the processing circuit 160 of the medium feed apparatus 100 and performs medium reading processing, etc., instead of the processing circuit 160. The processing circuit 260 has a control circuit 261, detection circuit 262, skew determination circuit 263, attachment determination circuit 264, etc. Note that, these parts may be configured by respectively independent integrated circuits, microprocessors, firmware, etc.

The control circuit 261 is one example of a control module and has functions similar to the control module 161. The control circuit 261 receives operating signals from the operating device 105 or the interface device 144. Further, the control circuit 261 receives a first medium signal, second medium signal, third medium signal, and fourth medium signal respectively from the first medium sensor 111, second medium sensor 117, third medium sensor 118, and fourth medium sensor 124. Further, the control circuit 261 receives distance signals and rotation signals respectively from the first encoder 112 and the second encoder 116. Further, the control circuit 261 reads out the results of determination of skew and the results of detection of the size of the medium from the storage device 150. The control circuit 261 controls the first motor 141, second motor 142, and third motor 143 based on the received signals and/or read out information. Further, the control circuit 261 acquires an input image from the imaging device 125 and outputs it to the interface device 144.

The detection circuit 262 is one example of a detection module and has functions similar to the detection module 162. The detection circuit 262 respectively receives a distance signal and fourth medium signal from the first encoder 112 and the fourth medium sensor 124. The detection circuit 262 detects the size of the medium based on the received signals and stores the detection results in the storage device 150.

The skew determination circuit 263 is one example of a skew determination module and has functions similar to the skew determination module 163. The skew determination circuit 263 receives the first skew signal and the second skew signal respectively from the first skew sensor 119 and the second skew sensor 120. The skew determination circuit 263 determines whether skew of the medium has occurred based on the received signals and stores the result of determination in the storage device 150.

The attachment determination circuit 264 is one example of an attachment determination module and has functions similar to the attachment determination module 164. The attachment determination circuit 264 receives an ultrasonic wave signal from the ultrasonic sensor 121. The attachment determination circuit 264 determines if the medium has an attachment based on the received ultrasonic wave signal and outputs an alert to the interface device 144 in accordance with the result of determination.

As explained in detail above, the medium feed apparatus can suitably feed a medium even when using the processing circuit 260.

Above, preferable embodiments are explained, but the embodiments are not limited to these. For example, the medium feed apparatus 100 may determine whether the front end of the succeeding sheet of the medium has reached the separation part by utilizing another sensor instead of the second encoder 116. For example, the medium feed apparatus 100 uses an ultrasonic sensor to determine whether the front end of the succeeding sheet of the medium has reached the separation part. In this case, an ultrasonic sensor similar to the ultrasonic sensor 121 is located at a position overlapping the nip part of the feed roller 114 and the separation roller 115 seen from the width direction A4. At step S108 or S118, the control module 161 receives an ultrasonic wave signal from the ultrasonic sensor. If the signal value of the received ultrasonic wave signal is less than an overlap threshold value, it determines that the front end of the succeeding sheet of the medium has reached the separation module.

Alternatively, the medium feed apparatus 100 may determine whether the front end of the succeeding sheet of the medium has reached the separation part based on the amount of current flowing through the second motor 142. In this case, as the second motor 142, a DC (direct current) motor is used. A DC motor is low cost and can be easily adjusted in speed, but the rotational speed of a DC motor changes depending on load fluctuations and other external factors. The more the rotational speed of the motor falls, the greater the torque of the motor becomes. The greater the torque of the motor becomes, the greater the amount of current that flows to the motor. At step S108 or S118, the control module 161 receives the amount of current flowing through the second motor 142 from the second motor 142. If the received amount of current is a current threshold value or more, it determines that the front end of the succeeding sheet of the medium has reached the separation part. The current threshold value is set by prior experiments to the average value, center value, minimum value, or maximum value of the amount of current flowing to the DC motor when reverse rotation of the DC motor occurs.

Alternatively, the medium feed apparatus 100 may use an optical sensor to determine whether the front end of the succeeding sheet of the medium has reached the separation part. In this case, the optical sensor is located to capture the region of the medium being fed overlapping with the nip part of the feed roller 114 and separation roller 115 seen from the width direction A4 from below. The optical sensor has a light emitter and light receiver provided at the same side with respect to the conveyance path of the medium and detects movement of the medium in the medium conveyance direction A2 and width direction A4. The light emitter is an LED, etc. and emits light toward the conveyance path. The light receiver captures images corresponding to the light received every constant time period and detects common parts from a latest image and immediately preceding image. The light receiver calculates the movement direction and movement speed of the conveyed medium based on changes in position of the detected common parts in the image and generates and outputs a movement signal indicating the calculated movement direction and movement speed. The "constant time period" is, for example, a time period corresponding to 100 operating pulses worth of the second motor 142. At step S108 or S118, the control module 161 receives a movement signal from the optical sensor. If the signal value of the received movement signal indicates that the medium is moving from the upstream side toward the downstream side, it determines that the front end of the succeeding sheet of the medium has reached the separation part.

The medium feed apparatus 100 may utilize another sensor instead of the first encoder 112 to similarly determine whether the back end of the preceding sheet of the medium has passed the position of the pick roller 113. For example, the medium feed apparatus 100 uses an optical sensor to determine whether the back end of the preceding sheet of the medium has passed the position of the pick roller 113. In this case, the above-mentioned optical sensor is located to capture the region of the medium stacked on the stacking tray 103 overlapping with the nip part of the pick roller 113 seen from the width direction A4 from above. At step S113, the control module 161 receives a movement signal from the optical sensor. If the signal value of the received movement signal does not indicate that the medium is moving from the upstream side toward the downstream side, it determines that the back end of the preceding sheet of the medium has passed the position of the pick roller 113.

Further, if using the second encoder 116 for determining the front end of the succeeding sheet of the medium has reached the separation part, the medium feed apparatus 100 may also perform other functions utilizing the second encoder 116. For example, the control module 161 controls the second motor 142 to rotate the separation roller 115 when starting up the medium feed apparatus 100 while acquiring a rotation signal from the second encoder 116. If the signal value of the rotation signal indicates that the separation roller 115 is not rotating, the control module 161 determines that the separation roller 115 is not attached properly or has been forgotten to attach or that the separation roller 115 or the second encoder 116 has broken down. Further, the control module 161 controls the first motor 141 to rotate the feed roller 114 when starting up the medium feed apparatus 100 while acquiring a rotation signal from the second encoder 116. If the signal value of the rotation signal indicates that the separation roller 115 is not rotating, the control module 161 determines that the surface of the feed roller 114 or separation roller 115 is dirty and the frictional force between the feed roller 114 and the separation roller 115 has decreased. In these cases, the control module 161 sends information indicating an alert through the interface device 144 to an information processing apparatus to thereby notify the user of the alert.

Further, the control module 161 may also determine whether a succeeding sheet of the medium has reached the separation part based on the rotation signal from the second encoder 116 when a preceding sheet of the medium to be fed has passed the separation part. If the succeeding sheet of the medium has not reached the separation part while the preceding sheet of the medium is passing the separation part, the separation roller 115 is rotated in the medium feed direction by the feed roller 114. On the other hand, if the succeeding sheet of the medium reaches the separation part while the preceding sheet of the medium is passing the separation part, the separation roller 115 stops or rotates in the direction A13 opposite to the medium feed direction.

Therefore, if the signal value of the rotation signal indicates that the separation roller 115 is rotating in the medium feed direction, the control module 161 determines that the succeeding sheet of the medium has not reached the separation part. On the other hand, if the signal value of the rotation signal indicates that the separation roller 115 stops or rotates in the direction A13 opposite to the medium feed direction, the control module 161 determines that the succeeding sheet of the medium has reached the separation part. If the control module 161 determines that the succeeding sheet of the medium has reached the separation part when the preceding sheet of the medium to be fed has passed the separation part, for example, it delays the feed timings of the feed roller 114 and pick roller 113. In this way, the control module 161 can sufficiently widen the distance between two sheets of the medium successively fed and keep sheets of the medium from striking each other or parts of the input images from being dropped.

According to the embodiment, the medium feed apparatus, medium feed method, and computer-readable, non-transitory medium can keep multi-feed of the medium from occurring while decreasing the time required for feed of the medium.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to presenting the superiority and inferiority of the invention. Although the embodiment(s) of the present inventions have been described in detail, it should be understood that the various changes, substitutions, and alterations could be made hereto without departing from the spirit and scope of the invention.

What is claimed is:

1. A medium feed apparatus comprising:

a stacking tray;

a feed roller configured to feed a medium;

a separation roller located facing the feed roller;

a pick roller located at an upstream side from the feed roller and the separation roller in a medium conveyance direction;

a first sensor located at the upstream side from the pick roller in the medium conveyance direction;

a second sensor located at a downstream side from the feed roller and the separation roller in the medium conveyance direction; and a processor to rotate the pick roller and the feed roller in a medium feed direction to feed a plurality of sheets of the medium stacked on the stacking tray, wherein the processor stops the pick roller when the second sensor detects a front end of a preceding sheet of medium;

rotates the pick roller again to advance a succeeding sheet of medium after the first sensor detects a back end of the preceding sheet of medium; and changes a timing of rotating the pick roller again based on whether the second sensor has detected the front end of the preceding sheet of medium before a predetermined time elapses from when starting feeding the medium, whether skew of the preceding sheet of medium has occurred, or whether a size of the preceding sheet of medium is less than a predetermined size.

2. The medium feed apparatus according to claim 1, further comprising a third sensor to detect rotation of the separation roller, wherein after rotating the pick roller again, the processor stops the pick roller again to stop advancing the succeeding sheet of medium when the third sensor detects that the separation roller stops or rotates in the direction opposite to the medium feed direction.

3. The medium feed apparatus according to claim 2, wherein the processor determines whether the back end of the preceding sheet of medium has passed the feed roller and the separation roller after stopping the pick roller again, and rotates the pick roller again to feed the succeeding sheet of medium when the processor determines that the back end of the preceding sheet of medium has passed the feed roller and the separation roller.

4. The medium feed apparatus according to claim 3, wherein the processor sets a rotational speed of the pick roller at the time of rotating the pick roller again when the back end of the preceding sheet of medium has passed the feed roller and the separation roller to a faster speed than the rotational speed of the pick roller at the time of rotating the pick roller again when the first sensor detects the back end of the preceding sheet of medium.

5. The medium feed apparatus according to claim 1, wherein the processor detects the size of the preceding sheet of medium, and wherein the processor does not rotate the pick roller again when the first sensor detects the back end of the preceding sheet of medium if the size of the preceding sheet of medium is less than the predetermined size.

6. The medium feed apparatus according to claim 2, wherein the processor does not rotate the pick roller again when the first sensor detects the back end of the preceding sheet of medium if the third sensor detects that the separation roller stops or rotates in the direction opposite to the medium feed direction.

7. A medium feed apparatus comprising:

a stacking tray;

a feed roller configured to feed a medium;

a separation roller located facing the feed roller;

a pick roller located at an upstream side from the feed roller and the separation roller in a medium conveyance direction;

a first sensor located at an upstream side from the pick roller in the medium conveyance direction;

a second sensor located at a downstream side from the feed roller and the separation roller in the medium conveyance direction; and a processor to rotate the pick roller and the feed roller in a medium feed direction to feed a plurality of sheets of the medium stacked on the stacking tray, wherein the processor stops the pick roller when the second sensor detects a front end of a preceding sheet of medium; and rotates the pick roller again to advance a succeeding sheet of medium when the first sensor detects a back end of the preceding sheet of medium, and wherein the processor sets a rotational speed of the pick roller at the time of rotating the pick roller again when the first sensor detects the back end of the preceding sheet of medium to a lower speed than the rotational speed of the pick roller at the time of starting feed of the preceding sheet of medium.

8. A medium feed method comprising:

rotating a feed roller and a pick roller located at an upstream side from the feed roller and a separation roller located facing the feed roller in a medium conveyance direction in a medium feed direction to feed a plurality of sheets of the medium stacked on a stacking tray;

stopping the pick roller when a second sensor located at a downstream side from the feed roller and the separation roller in the medium conveyance direction detects a front end of a preceding sheet of medium; and rotating the pick roller again to advance a succeeding sheet of medium after a first sensor located at an upstream side from the pick roller in the medium conveyance direction detects a back end of the preceding sheet of medium, and wherein a timing of rotating the pick roller again is changed, based on whether the second sensor has detected the front end of the preceding sheet of medium before a predetermined time elapses from when starting feed of the medium, whether skew of the preceding sheet of medium has occurred, or whether a size of the preceding sheet of medium is less than a predetermined size.

9. The method according to claim 8, further comprising, after rotating the pick roller again, stopping the pick roller again to stop advancing the succeeding sheet of medium when a third sensor detects that the separation roller stops or rotates in the direction opposite to the medium feed direction.

10. The method according to claim 9, further comprising, determining whether the back end of the preceding sheet of medium has passed the feed roller and the separation roller after stopping the pick roller again, and rotating the pick roller again to feed the succeeding sheet of medium when the back end of the preceding sheet of medium has passed the feed roller and the separation roller.

11. The method according to claim 10, further comprising setting a rotational speed of the pick roller at the time of rotating the pick roller again when the back end of the preceding sheet of medium has passed the feed roller and the separation roller to a faster speed than the rotational speed of the pick roller at the time of rotating the pick roller again when the first sensor detects the back end of the preceding sheet of medium.

12. The method according to claim 8, further comprising detecting the size of the preceding sheet of medium, wherein the pick roller is not rotated again when the first sensor detects the back end of the preceding sheet of medium if the size of the preceding sheet of medium is less than the predetermined size.

13. The method according to claim 9, wherein the pick roller is not rotated again when the first sensor detects the back end of the preceding sheet of medium if the third sensor detects that the separation roller stops or rotates in the direction opposite to the medium feed direction.

14. A medium feed method comprising:

rotating a feed roller and a pick roller located at an upstream side from the feed roller and a separation roller located facing the feed roller in a medium conveyance direction in a medium feed direction to feed a plurality of sheets of the medium stacked on a stacking tray;

stopping the pick roller when a second sensor located at a downstream side from the feed roller and the separation roller in the medium conveyance direction detects a front end of a preceding sheet of medium;

rotating the pick roller again to advance a succeeding sheet of medium when a first sensor located at an upstream side from the pick roller in the medium conveyance direction detects a back end of the preceding sheet of medium, wherein a rotational speed of the pick roller at the time of rotating the pick roller again when the first sensor detects the back end of the preceding sheet of medium is set to a lower speed than the rotational speed of the pick roller at the time of starting feed of the preceding sheet of medium.

* * * * *